US009748667B2

(12) United States Patent
Nakamura

(10) Patent No.: US 9,748,667 B2
(45) Date of Patent: Aug. 29, 2017

(54) TERMINAL DEVICE AND ANTENNA SWITCHING METHOD

(71) Applicant: FUJITSU LIMITED, Kawasaki-shi, Kanagawa (JP)

(72) Inventor: Takafumi Nakamura, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 180 days.

(21) Appl. No.: 14/695,343

(22) Filed: Apr. 24, 2015

(65) Prior Publication Data

US 2015/0318625 A1 Nov. 5, 2015

(30) Foreign Application Priority Data

May 2, 2014 (JP) ..... 2014-095329

(51) Int. Cl.
*H01Q 3/24* (2006.01)
*H01Q 21/28* (2006.01)
*H01Q 1/24* (2006.01)

(52) U.S. Cl.
CPC ..... *H01Q 21/28* (2013.01); *H01Q 1/243* (2013.01)

(58) Field of Classification Search
None
See application file for complete search history.

(56) References Cited

U.S. PATENT DOCUMENTS 8,406,806 B2 * 3/2013 Wong ..... H01Q 1/243 455/550.1
8,698,764 B1 * 4/2014 Karakotsios ..... G06F 1/1692 345/173
2006/0197750 A1 * 9/2006 Kerr ..... G06F 1/1626 345/173
2009/0256809 A1 * 10/2009 Minor ..... G06F 3/03547 345/173
2010/0103136 A1 * 4/2010 Ono ..... G06F 3/0488 345/173
2012/0071203 A1 * 3/2012 Wong ..... H01Q 1/243 455/550.1
2013/0093680 A1 * 4/2013 Ogita ..... G06F 1/1626 345/168

(Continued)

FOREIGN PATENT DOCUMENTS

JP 2005-39566 A 2/2005
JP 2008-193384 A 8/2008
JP 2011-151658 A 8/2011

*Primary Examiner* — Trinh Dinh

(74) *Attorney, Agent, or Firm* — Westerman, Hattori, Daniels & Adrian, LLP

(57) ABSTRACT

A terminal device includes a first memory that stores a position of each of antennas included in a main body of a terminal device for each of holding manners for the main body of the terminal device, a second memory, a processor coupled to the second memory, configured to detect a holding manner for the main body of the terminal device including the antennas, detect a shape indicating a shadow of an object pointing to a surface of the terminal device, identify a holding hand that holds the main body of the terminal device, based on the detected shape, and switch an antenna which overlaps with the holding hand to another antenna based on the identified holding hand and the position of each antenna stored in the first memory, the antenna corresponding to the detected holding manner.

7 Claims, 14 Drawing Sheets

(56) References Cited

U.S. PATENT DOCUMENTS

2013/0169507 A1* 7/2013 Ko ..... H01Q 1/243
343/876
2013/0328723 A1* 12/2013 Rappaport ..... H04B 1/3838
342/372

* cited by examiner

TERMINAL DEVICE AND ANTENNA SWITCHING METHOD

CROSS-REFERENCE TO RELATED APPLICATION

This application is based upon and claims the benefit of priority of the prior Japanese Patent Application No. 2014-095329, filed on May 2, 2014, the entire contents of which are incorporated herein by reference.

FIELD

The embodiments discussed herein are related to a terminal device and an antenna switching method.

BACKGROUND

In a mobile terminal having a plurality of antennas, reception conditions deteriorate due to an effect of, for example, contact by a user to an antenna, and thus a method of switching between antennas has been proposed, in which reception conditions of each of the antennas are detected, and switching to an antenna having favorable reception conditions is performed. For example, a mobile terminal adopts a method in which the touch sensor on a display screen is divided into two sensor areas, and human body contact is monitored in each sensor area. The above-mentioned mobile terminal monitors contact of human body in each sensor area, and switches the antenna in one sensor area where contact has been detected to the antenna in the other sensor area where contact has not been detected.

Also, for a mobile terminal, a method has been proposed in which fluctuation in impedance characteristics of each antenna due to contact with a user is detected, thereby switching to an antenna having favorable reception conditions. For a mobile terminal, another method has been proposed in which the bit error rate (BER) of a signal, which is received by each antenna, is measured, thereby switching to an antenna having a lower BER. For a mobile terminal, still another method has been proposed in which antenna switching timing after a predetermined lapse of time is utilized, thereby avoiding frequent flip-flop of antenna switching. Related techniques are disclosed in, for example, Japanese Laid-open Patent Publication Nos. 2005-039566, 2011-151658, and 2008-193384.

SUMMARY

According to an aspect of the invention, a terminal device includes a first memory that stores a position of each of antennas included in a main body of a terminal device for each of holding manners for the main body of the terminal device, a second memory, a processor coupled to the second memory, configured to detect a holding manner for the main body of the terminal device including the antennas, detect a shape indicating a shadow of an object pointing to a surface of the terminal device, identify a holding hand that holds the main body of the terminal device, based on the detected shape, and switch an antenna which overlaps with the holding hand to another antenna based on the identified holding hand and the position of each antenna stored in the first memory, the antenna corresponding to the detected holding manner.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

A user touches one of sensor areas with the user's operating hand and holds the body of a mobile terminal with the user's holding hand which is not in contact with the other of the sensor areas, but the holding hand may cover an antenna in the other sensor area. However, contact of the holding hand is not detected in the other sensor area, and so the mobile terminal switches to the antenna in the other sensor area. Consequently, although the mobile terminal switches to select the antenna in the other sensor area, reception conditions deteriorate because the antenna in the other sensor area is covered by the holding hand.

In a mobile terminal that switches between antennas according to change in impedance characteristics, the impedance characteristics may be measured only at the time of transmission, and thus the timing for switching between antennas is limited.

The present disclosure provides a terminal device, an antenna switching program, and an antenna switching method that are capable of switching to select an antenna having favorable communication quality.

Hereinafter, embodiments of a terminal device, an antenna switching program, and an antenna switching method disclosed in the present application will be described in detail with reference to the accompanying drawings. It is to be noted that disclosed techniques are not limited by the embodiments. The embodiments presented below may be appropriately combined in a range without causing inconsistency.

First Embodiment

Figure 1:
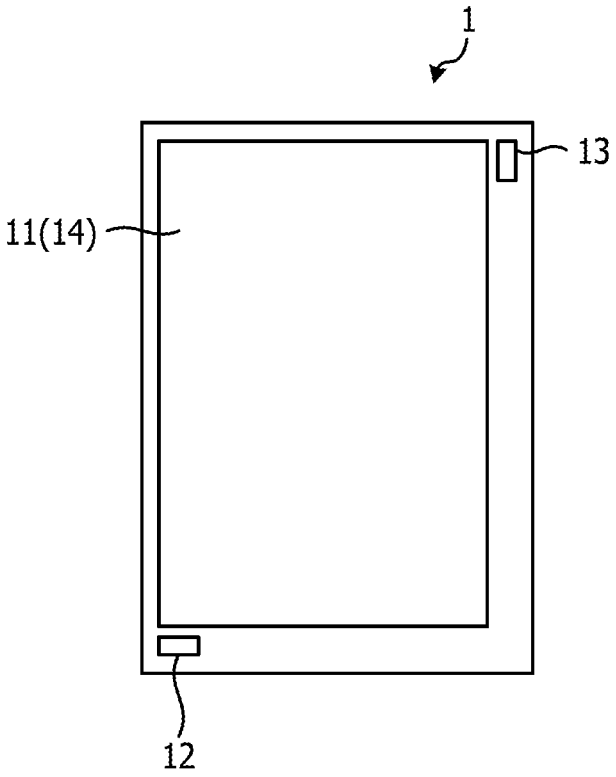
FIG. 1 is an explanatory diagram illustrating an example mobile terminal according to a first embodiment.

FIG. 1 is an explanatory diagram illustrating an example mobile terminal according to a first embodiment. A mobile terminal 1 illustrated in FIG. 1 represents a terminal device such as a smartphone, a tablet terminal, or a mobile phone. The mobile terminal 1 has a display unit 11, a first antenna 12, and a second antenna 13. The display unit 11 is an output interface that displays various information on the screen. It is assumed that a touch sensor 14 is incorporated in the surface of the mobile terminal 1. For example, when the display screen is in portrait style which is vertically long as illustrated in FIG. 1, the first antenna 12 is incorporated in the lower left end of the surface of the mobile terminal 1 and is used as the main antenna. When portrait style is adopted as illustrated in FIG. 1, the second antenna 13 is incorporated in the upper right end of the surface of the mobile terminal 1 and is used as the sub-antenna. The external sizes of the first antenna 12 and the second antenna 13 are each approximately several centimeters. The touch sensor 14 is disposed on the surface of the mobile terminal 1 to detect contact with the sensor area on the display screen of the display unit 11 as well as contact with the sensor area other than the display screen of the display unit 11. The touch sensor 14 obtains the electrostatic capacitance on the sensor area.

Figure 2:
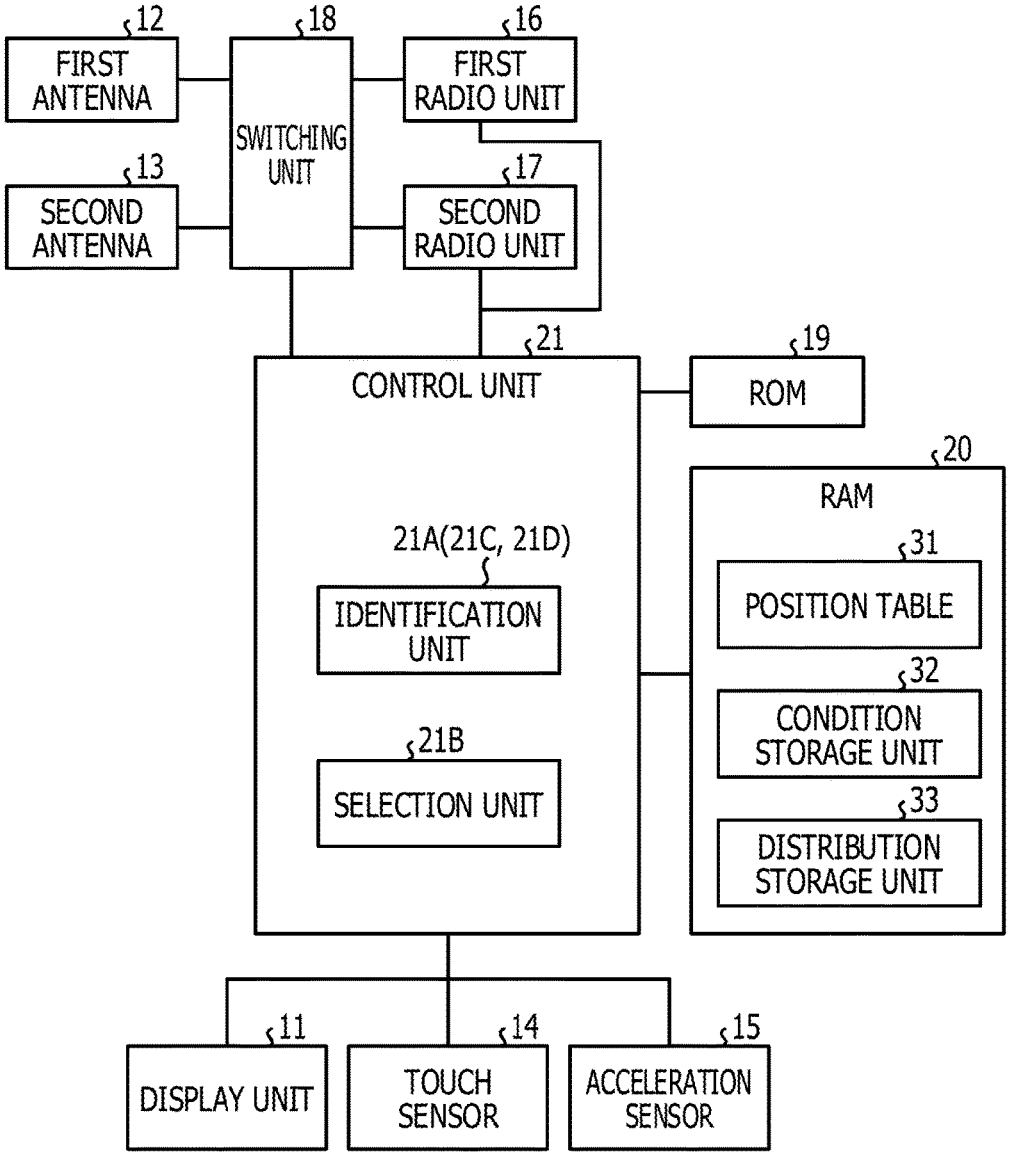
FIG. 2 is a block diagram illustrating the example mobile terminal.

FIG. 2 is a block diagram illustrating the example mobile terminal 1. The mobile terminal 1 illustrated in FIG. 2 has an acceleration sensor 15, a first radio unit 16, a second radio unit 17, and a switching unit 18 in addition to the display unit 11, the first antenna 12, the second antenna 13, and the touch sensor 14. Furthermore, the mobile terminal 1 has a read only memory (ROM) 19, a random access memory (RAM) 20, and a control unit 21. The acceleration sensor 15 is a sensor that detects acceleration in each of the directions of predetermined axes of the mobile terminal 1, for example, three axes of the x-axis, the y-axis, and the z-axis.

The first radio unit 16 is a communication interface that has a transmission function and a reception function, and performs radio communication by a radio system using 2 GHz band, for example. The first radio unit 16 is connected to, for example, the first antenna 12, and transmits information via the first antenna 12 and receives information via the first antenna 12. The second radio unit 17 is a communication interface that has a reception function and is connected to, for example, the second antenna 13 to receive information via the second antenna 13. For the sake of convenience of description, the first radio unit 16 is preferentially used instead of the second radio unit 17. When an operating hand of a user just covers an antenna used in a radio system operating at a high frequency band of 2 GHz, the amount of attenuation is larger compared with an antenna used in a radio system operating at a low frequency band of 800 MHz.

For example, based on per frequency conditions of antennas that receive a plurality of radio waves, a priority among the radio waves, and a switching frequency in carrier aggregation in LTE system, the mobile terminal 1 improves the overall efficiency by determining allocation of antennas. The descending order of communication quality of the antennas in a radio system using 2 GHz band as an example is the first antenna 12, the second antenna 13, the first antenna 12 covered with a hand, the second antenna 13 covered with a hand. The descending order of communication quality of the antennas in a radio system using 800 MHz band as an example is the first antenna 12, and the second antenna 13. The transmission function and the reception function for radio wave 1, and the transmission function and the reception function for radio wave 2 have equivalent priority of radio wave. The reception function for the radio wave 1 and the reception function for the radio wave 2 are equivalent.

The switching unit 18 switches connection between the first antenna 12, the second antenna 13, and the first radio unit 16, the second radio unit 17. The switching unit 18 connects the first antenna 12 to the first radio unit 16, and connects the second antenna 13 to the second radio unit 17. The switching unit 18 also connects the first antenna 12 to the second radio unit 17, and connects the second antenna 13 to the first radio unit 18.

ROM 19 is an area that stores information relevant to various information programs such as an antenna switching program. RAM 20 is an area that stores various information. The RAM 20 has a position table 31, a condition storage unit 32, and a distribution storage unit 33. The position table 31 is an area that stores position information which indicates the positions of the first antenna 12 and the second antenna 13 in the mobile terminal 1. The initial value of the position information is, for example, relative antenna position {(0, 1), (2, 0)} when the surface of the mobile terminal 1 is represented by a 2×2 matrix. For example, (0, 1) indicates the position of the second antenna 13 in portrait style, that is, the "upper right" position as viewed from the front of the mobile terminal 1. As illustrated in FIG. 1, (2, 0) indicates the position of the first antenna 12 in portrait style, that is, the "lower left" position as viewed from the front of the mobile terminal 1. In portrait style, the position table 31 stores position information {(0, 1), (2, 0)} of the main antenna at the "lower left" and the sub-antenna at the "upper right". In landscape style, the position table 31 stores position information {(1, 0), (0, 2)} of the main antenna at the "lower right" and the sub-antenna at the "upper left". It is to be noted that the landscape style is a style in which the display screen is used in a horizontally long manner.

The condition storage unit 32 is an area that stores a manner of holding the current mobile terminal 1, portrait style or landscape style as an example, a number of setting times described later, and a count value for a holding hand. The holding manner indicates a manner of using the mobile terminal 1, portrait style or landscape style as an example. It is to be noted that the holding manner is identified based on a result of detection by the acceleration sensor 15. The number of setting times is a number that is incremented by 1 when the same antenna position of the display screen according to a holding manner is set. The count value for a holding hand corresponds to the later-described number of events in which a holding hand of a user of the mobile terminal 1 is identified, and includes a count value for the left holding hand corresponding to the number of events in which left hand holding is identified, and a count value for the right holding hand corresponding to the number of events in which right hand holding is identified. The distribution storage unit 33 successively obtains electrostatic capacitance at contact point via the touch sensor 14, and stores a distribution of electrostatic strength based on the successively obtained electrostatic capacitance.

The control unit 21 controls the entire mobile terminal 1. The control unit 21 identifies use conditions of the mobile terminal 1, for example, the manner in which a user holds the mobile terminal 1 and the holding manner of the mobile terminal 1, based on sensor values in the directions of three axes detected by the acceleration sensor 15. In addition, the control unit 21 determines whether the mobile terminal 1 is on the move in a bag, a pocket, or in use according to activation or inactivation of application.

The control unit 21 reads an antenna switching program stored in the ROM 19, and achieves the function of each of various processes based on the read antenna switching program. The control unit 21 functionally serves as an identification unit 21A and a selection unit 21B.

Figure 3A:
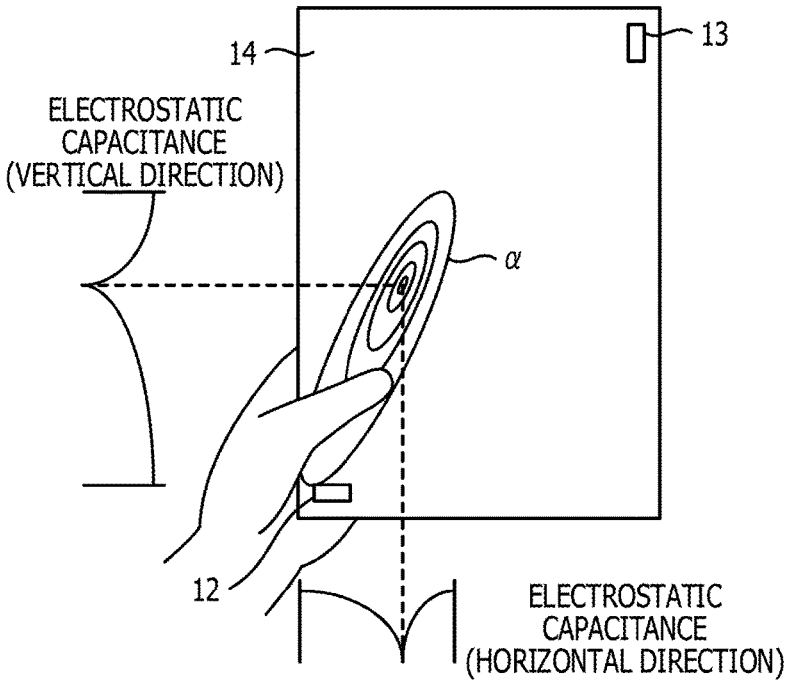
FIG. 3A is an explanatory diagram illustrating an example distribution of electrostatic strength due to a holding hand and an operating hand.
Figure 3B:
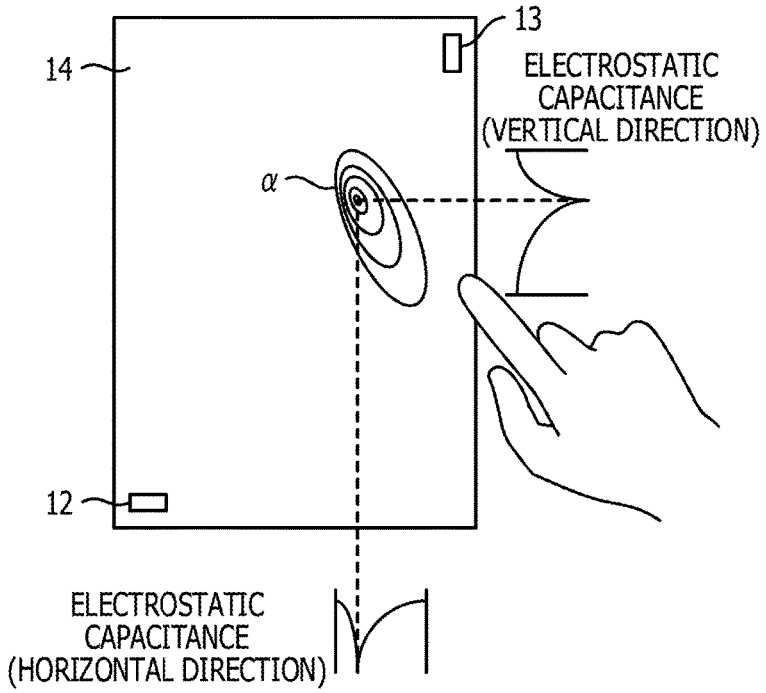
FIG. 3B is an explanatory diagram illustrating an example distribution of electrostatic strength due to a holding hand and an operating hand.

The identification unit 21A identifies a hand and a type of finger of a user based on the electrostatic strength distribution obtained by the touch sensor 14, and based on a result of the identification, identifies the holding hand and the operating hand of the user. FIGS. 3A and 3B are each an explanatory diagram illustrating an example distribution of electrostatic strength due to a holding hand and an operating hand. FIG. 3A is an explanatory diagram illustrating an example electrostatic strength distribution with the left holding hand and the left operating hand. FIG. 3B is an explanatory diagram illustrating an example electrostatic strength distribution with the left holding hand and the right operating hand.

The electrostatic strength distribution α illustrated in FIGS. 3A and 3B indicates the strength distribution of the electrostatic capacitance of the touch sensor 14 in the planar direction, that is, a vertical direction and a horizontal direction. The electrostatic strength distribution α illustrated in FIGS. 3A and 3B is stronger near the hand and weaker away from the hand, and so it may be determined that an area with a dispersed distribution is near the hand, and an area with a dense distribution is away from the hand. Because the electrostatic strength distribution α forms an elliptical shape, the holding hand and the operating hand may be identified by the inclination of the elliptical shape.

As illustrated in FIG. 3A, when the electrostatic strength distribution a extends from near a side of the mobile terminal 1 and the electrostatic strength distribution α is inclined to the right, the identification unit 21A identifies left hand holding and left hand operation. When the electrostatic strength distribution α extends from near a side of the mobile terminal 1 and the electrostatic strength distribution α is inclined to the left, the identification unit 21A identifies right hand holding and right hand operation.

In addition, as illustrated in FIG. 3B, when the electrostatic strength distribution α does not extend from near a side of the mobile terminal 1 and the electrostatic strength distribution α is inclined to the left, the identification unit 21A identifies left hand holding and right hand operation. When the electrostatic strength distribution α does not extend from near a side of the mobile terminal 1 and the electrostatic strength distribution α is not inclined to the left, the identification unit 21A identifies right hand holding and left hand operation.

The selection unit 21B determines whether or not the number of setting times and the count value satisfy predetermined conditions. For example, the predetermined conditions are that the number of setting times of the same antenna position is 10 consecutive times or more, and the count value for the same hand holding is 8 consecutive times or more. When the number of setting times and the count value satisfy the predetermined conditions, the selection unit 21B determines whether or not the holding hand and the position of the antenna that is being used by the first radio unit 16 overlap with each other. When the holding hand and the position of the antenna being used by the first radio unit 16 overlap with each other, the selection unit 21B controls the switching unit 18 to switch from the antenna in use by the first radio unit 16 to the other antenna. For example, when the antenna in use by the first radio unit 16 is the first antenna 12, the selection unit 21B switches from the first antenna 12 to the second antenna 13. When the antenna in use by the first radio unit 16 is the second antenna 13, the selection unit 21B switches from the second antenna 13 to the first antenna 12.

Figure 4:
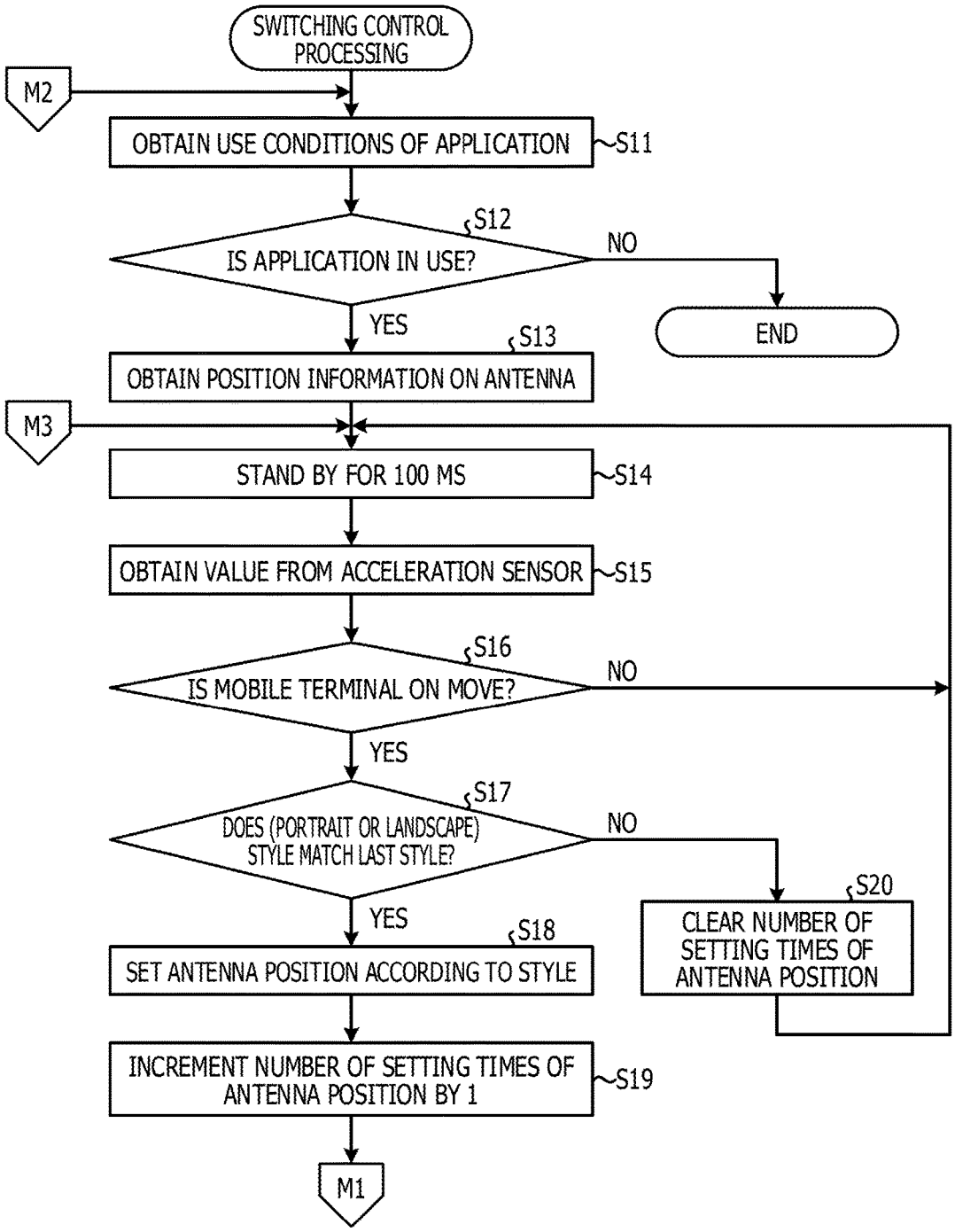
FIG. 4 is a flow chart illustrating an example processing operation of a control unit of the mobile terminal, the control unit being responsible for switching control processing according to the first embodiment.
Figure 5:
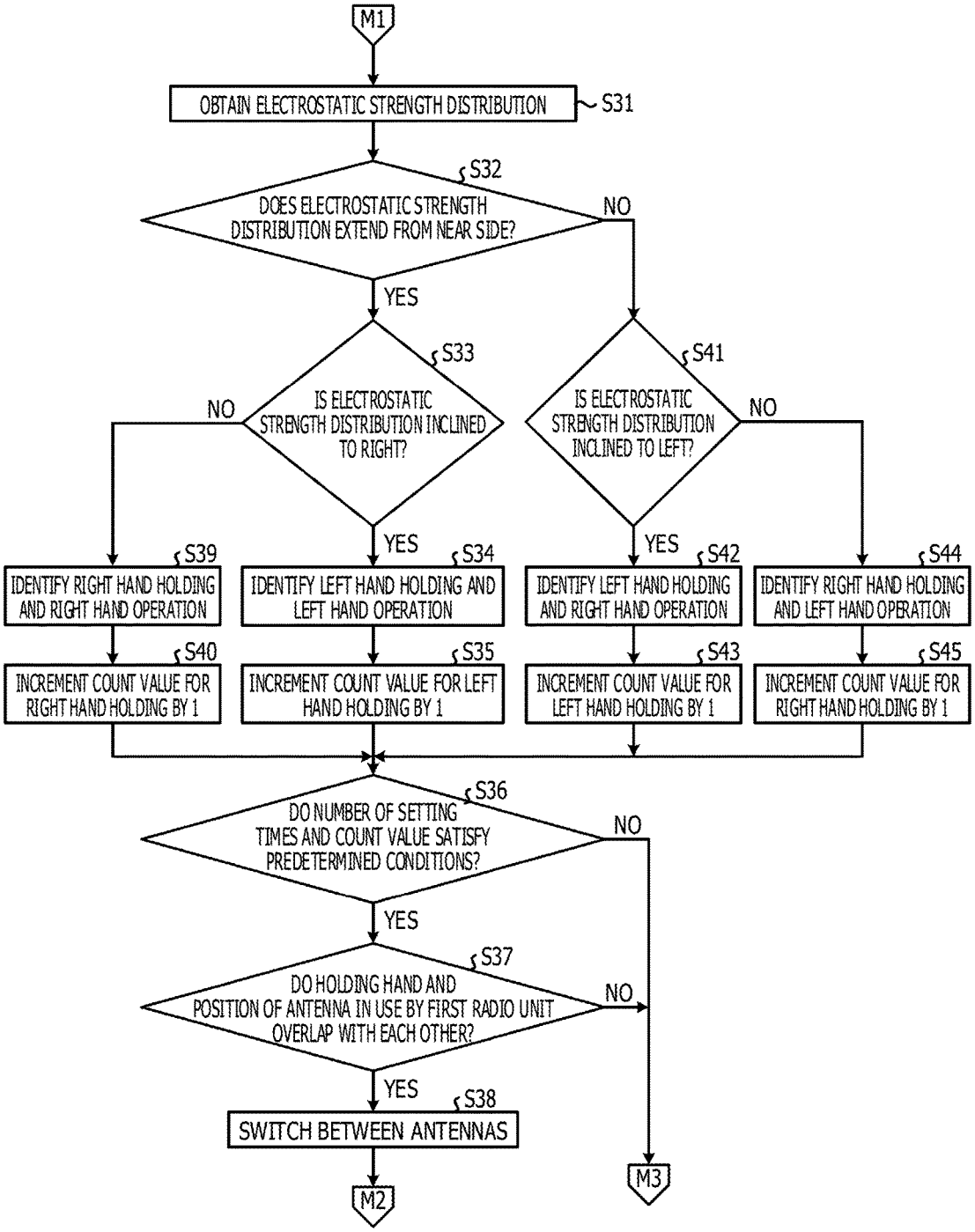
FIG. 5 is a flow chart illustrating an example processing operation of a control unit of the mobile terminal, the control unit being responsible for the switching control processing according to the first embodiment.

Next, the operation of the mobile terminal 1 according to the first embodiment will be described. FIGS. 4 and 5 are each a flow chart illustrating an example processing operation of the control unit 21 of the mobile terminal 1, the control unit 21 being responsible for switching control processing according to the first embodiment. The switching control processing illustrated in FIGS. 4 and 5 is processing in which the holding hand for the mobile terminal 1 is identified based on the inclination of the electrostatic strength distribution α obtained by the touch sensor 14, and when the position of the antenna in use by the first radio unit 16 and the holding hand overlap with each other, the antenna in use is switched.

In FIG. 4, the control unit 21 obtains use conditions of application (step S11). It is to be noted that the application is, for example, an application that uses radio communication. The control unit 21 determines whether or not the mobile terminal 1 is in use based on the obtained use conditions (step S12). When the mobile terminal 1 is in use (YES in step S12), the control unit 21 obtains the position information on the first antenna 12 and the second antenna 13 stored in the position table 31 (step S13). It is to be noted that the position information on the first antenna 12 and the second antenna 13 stored in the position table 31 is information that indicates the relative position of each antenna.

The control unit 21 stands by for 100 msec (step S14), and obtains a sensor value from the acceleration sensor 15 (step S15). It is to be noted that the stand-by for 100 msec is for avoiding frequent flip-flop of antenna switching. After obtaining the sensor value from the acceleration sensor 15, the control unit 21 determines whether or not the mobile terminal 1 on the move based on the obtained sensor value (step S16). When the mobile terminal 1 is on the move (YES in step S16), the control unit 21 determines whether or not the holding manner of the mobile terminal 1 matches the holding manner of the last time (step S17). The control unit 21 identifies the holding manner of the mobile terminal 1 based on the sensor value from the acceleration sensor 15. The holding manner includes, for example, portrait style and landscape style.

When the holding manner matches the holding manner of the last time (YES in step S17), the control unit 21 sets an antenna position according to the holding manner (step S18). It is to be noted that the antenna position according to the holding manner corresponds to each antenna position in portrait style and each antenna position in landscape style. The holding manner of the last time is the holding manner that is identified 100 msec ago, for example. After setting an antenna position according to the holding manner, the control unit 21 increments the number of setting times of the antenna position stored in the condition storage unit 32 by 1 (step S19), and causes the flow to proceed to M1 illustrated in FIG. 5.

When the holding manner does not match the holding manner of the last time (NO in step S17), the control unit 21 clears the number of setting times of the antenna position (step S20), and the flow proceeds to step S14 to stand by for 100 msec. Consequently, frequent flip-flop of antenna switching may be avoided. When the mobile terminal 1 is not in use (NO in step S12), the control unit 21 determines that the mobile terminal 1 is unused, and terminates the processing operation illustrated in FIG. 4. When the mobile terminal 1 is not on the move (NO in step S16), the control unit 21 causes the flow to proceed to step S14.

In M1 illustrated in FIG. 5, the control unit 21 successively obtains electrostatic strength distribution α on the touch sensor 14 (step S31). The touch sensor 14 successively obtains electrostatic capacitance according to contact detected in the sensor area, and stores electrostatic strength distribution a in the distribution storage unit 33, the electrostatic strength distribution α being formed based on the successively obtained electrostatic capacitance. The identification unit 21A in the control unit 21 determines whether or not the electrostatic strength distribution α in the distribution storage unit 33 extends from near a side of the mobile terminal 1 (step S32). The identification unit 21A determines whether or not the electrostatic strength distribution α extends from near one of four sides of the display screen of the mobile terminal 1.

When the electrostatic strength distribution α extends from near a side of the mobile terminal 1 (YES in step S32), the identification unit 21A identifies the holding hand of a user that holds the mobile terminal 1, and determines whether or not the electrostatic strength distribution α is inclined to the right (step S33). The right inclination of the electrostatic strength distribution α is the inclination as illustrated in FIG. 3A.

When the electrostatic strength distribution α is inclined to the right as illustrated in FIG. 3A (YES in step S33), the identification unit 21A identifies left hand holding and left hand operation (step S34). Since the identification unit 21A has identified left hand holding, the count value for left hand holding is incremented by 1 (step S35). The selection unit 21B of the control unit 21 determines whether or not the number of setting times and the count value for a holding hand satisfy predetermined conditions (step S36). For example, the predetermined conditions are that the number of setting times of the same antenna position is 10 consecutive times or more, and the count value for the same hand holding out of the count value for left hand holding and the count value for right hand holding is 8 consecutive times or more.

When the number of setting times and the count value satisfy the predetermined conditions (YES in step S36), the selection unit 21B determines whether or not the holding hand and the position of the antenna in use by the first radio unit 16 overlap with each other (step S37). When the second antenna and the first antenna are at absolute positions of (0, 1) and (2, 0), respectively in portrait style, the selection unit 21B assumes that the left holding hand is at (1, 0) and the right holding hand is at (0, 1), for example. In this case, when the holding hand is the left hand and the position of the antenna in use is at (2, 0), the selection unit 21B performs an operation between (2, 0), and (1, 0) for left holding and the operation gives a result (2, 0), and thus the selection unit 21B determines that the holding hand and the position of the antenna in use overlap with each other. When the holding hand is the right hand and the position of the antenna in use is at (2, 0), the selection unit 21B performs an operation between (2, 0), and (0, 1) for right hand holding and the operation gives a result (0, 0), and thus the selection unit 21B determines that the holding hand and the position of the antenna in use do not overlap with each other.

When the holding hand and the position of the antenna in use by the first radio unit 16 overlap with each other (YES in step S37), the selection unit 21B switches the antenna in use by the first radio unit 16 to the other antenna (step S38), and causes the flow to proceed to M2 illustrated in FIG. 4. For example, when the antenna in use by the first radio unit 16 is the first antenna 12, the selection unit 21B switches the first antenna 12 to the second antenna 13. Conversely, for example, when the antenna in use by the first radio unit 16 is the second antenna 13, the selection unit 21B switches the second antenna 13 to the first antenna 12.

When the electrostatic strength distribution α is not inclined to the right (NO in step S33), the identification unit 21A identifies right hand holding and right hand operation (step S39). Since the identification unit 21A has identified right hand holding, the count value for right hand holding is incremented by 1 (step S40). The selection unit 21B causes the flow to proceed to step S36 to determine whether or not the number of setting times and the count value satisfy the predetermined conditions.

When the electrostatic strength distribution α does not extend from near a side of the mobile terminal 1 (NO in step S32), the identification unit 21A determines whether or not the electrostatic strength distribution α is inclined to the left (step S41). When the electrostatic strength distribution α is inclined to the left as illustrated in FIG. 3B (YES in step S41), the identification unit 21A identifies left hand holding and right hand operation (step S42). Since the identification unit 21A has identified left hand holding, the count value for left hand holding is incremented by 1 (step S43). The selection unit 21B causes the flow to proceed to step S36 to determine whether or not the number of setting times and the count value satisfy the predetermined conditions.

On the other hand, when the electrostatic strength distribution α is not inclined to the left (NO in step S41), the identification unit 21A identifies right hand holding and left hand operation (step S44). Since the identification unit 21A has identified right hand holding, the count value for right hand holding is incremented by 1 (step S45). The selection unit 21B causes the flow to proceed to step S36 to determine whether or not the number of setting times and the count value satisfy the predetermined conditions.

When the electrostatic strength distribution α extends from near a side of the mobile terminal 1 and the electrostatic strength distribution α is inclined to the right, the control unit 21, which performs switching control processing, identifies left hand holding and left hand operation, then increments the count value for left hand holding by 1.

When the electrostatic strength distribution α extends from near a side of the mobile terminal 1 and the electrostatic strength distribution α is not inclined to the right, the control unit 21 identifies right hand holding and right hand operation, then increments the count value for right hand holding by 1.

When the electrostatic strength distribution α does not extend from near a side of the mobile terminal 1 and the electrostatic strength distribution α is inclined to the left, the control unit 21 identifies left hand holding and right hand operation, then increments the count value for left hand holding by 1.

When the electrostatic strength distribution α does not extend from near a side of the mobile terminal 1 and the electrostatic strength distribution α is not inclined to the left, the control unit 21 identifies right hand holding and left hand operation, then increments the count value for right hand holding by 1.

When the number of setting times of antenna position and the count value for a holding hand satisfy the predetermined conditions and the holding hand and the position of the antenna in use by the first radio unit 16 overlap with each other, the control unit 21 switches the antenna in use to the other antenna. Consequently, an antenna having favorable communication quality may be selected while avoiding frequent flip-flop of antenna switching.

The control unit 21 according to the first embodiment identifies the holding hand and the operating hand based on the electrostatic strength distribution α obtained by the touch sensor 14, and based on the identification result, identifies one of left hand holding and left hand operation, right hand holding and right hand operation, left hand holding and right hand operation, and right hand holding and left hand operation.

The control unit 21 identifies a holding manner of the mobile terminal 1 based on a result of detection by the acceleration sensor 15, and identifies the antenna positions of the first antenna 12 and the second antenna 13 corresponding to the holding manner, from the position table 31.

In addition, when the number of setting times of antenna position and the count value for a holding hand satisfy the predetermined conditions and the holding hand and the position of the antenna in use by the first radio unit 16 overlap with each other, the control unit 21 switches the antenna in use to the other antenna. Consequently, an antenna having favorable communication quality may be selected while avoiding frequent flip-flop of antenna switching. Deterioration of communication quality due to a holding hand may be avoided. Furthermore, without being limited to during the time of transmission, the control unit 21 may be able to select an appropriate antenna even during the time of reception.

In the above-described first embodiment, the holding hand and the operating hand are identified based on the inclination of the electrostatic strength distribution α. However, the holding hand and the operating hand may be identified based on the inclination of contact shape with the sensor area of the touch sensor 14. The embodiment in this case will be described as a second embodiment below. It is to be noted that the same components as in the mobile terminal 1 according to the first embodiment will be denoted by the same symbol, and description of common components and operations will be omitted.

Second Embodiment

Figure 6A:
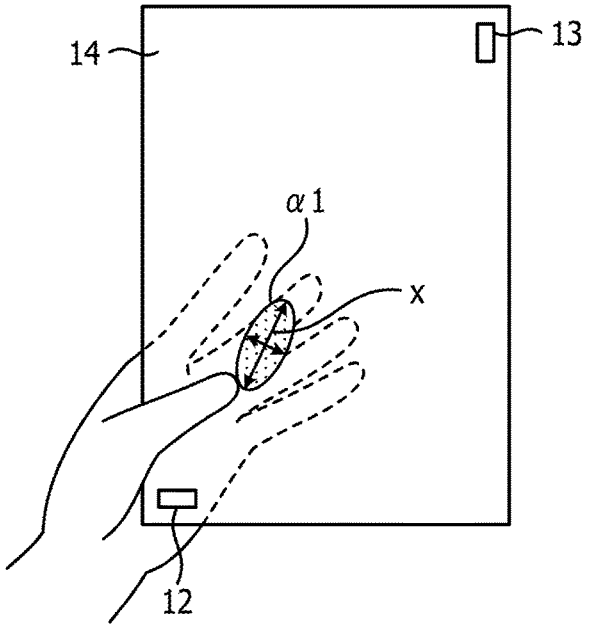
FIG. 6A is an explanatory diagram illustrating an example contact shape with a holding hand and an operating hand according to a second embodiment.
Figure 6B:
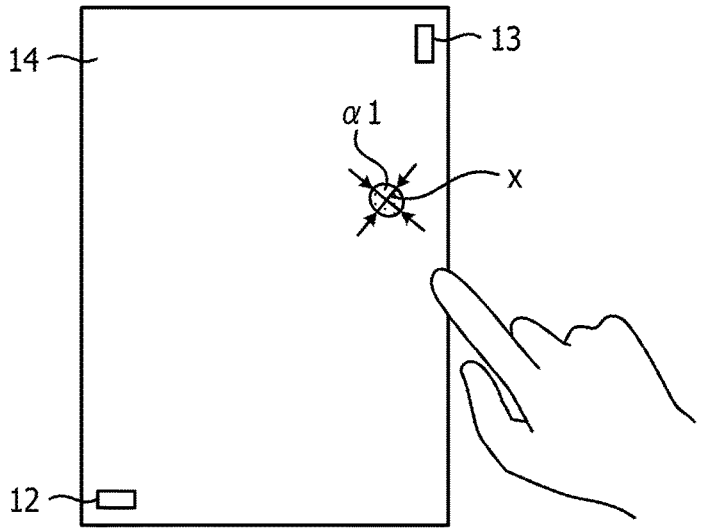
FIG. 6B is an explanatory diagram illustrating an example contact shape with a holding hand and an operating hand according to the second embodiment.

FIGS. 6A and 6B are each an explanatory diagram illustrating an example contact shape with a holding hand and an operating hand according to a second embodiment. FIG. 6A is an explanatory diagram illustrating an example contact shape in the case of left hand holding and left hand operation, and FIG. 6B is an explanatory diagram illustrating an example contact shape in the case of left hand holding and right hand operation. An identification unit 21C in the control unit 21 obtains a contact shape α1 on the sensor area from the touch sensor 14, and identifies the holding hand and the operating hand of a user based on the contact shape α1. The identification unit 21C determines whether or not the flattening of the contact shape (ellipse) al is 0.5 or greater. When the flattening of the contact shape α1 is 0.5 or greater, the identification unit 21C identifies the contact shape α1 as a thumb. In addition, when the flattening of the contact shape α1 is 0.5 or greater, the identification unit 21C determines whether or not the major axis X of the contact shape α1 is inclined to the right.

When the flattening of the contact shape α1 is 0.5 or greater and the major axis X of the contact shape α1 is inclined to the right as illustrated in FIG. 6A, the identification unit 21C identifies left hand holding and left hand operation. In addition, after identifying left hand holding, the identification unit 21C increments the count value for left hand holding by 1.

When the flattening of the contact shape α1 is 0.5 or greater and the major axis X of the contact shape α1 is not inclined to the right, the identification unit 21C identifies right hand holding and right hand operation. In addition, after identifying right hand holding, the identification unit 21C increments the count value for right hand holding by 1.

When the flattening of the contact shape α1 is less than 0.5 and the major axis X of the contact shape α1 is inclined to the left as illustrated in FIG. 6B, the identification unit 21C identifies left hand holding and right hand operation. In addition, after identifying left hand holding, the identification unit 21C increments the count value for left hand holding by 1.

When the flattening of the contact shape α1 is less than 0.5 and the major axis X of the contact shape α1 is not inclined to the left, the identification unit 21C identifies right hand holding and left hand operation. In addition, after identifying right hand holding, the identification unit 21C increments the count value for right hand holding by 1.

Figure 7:
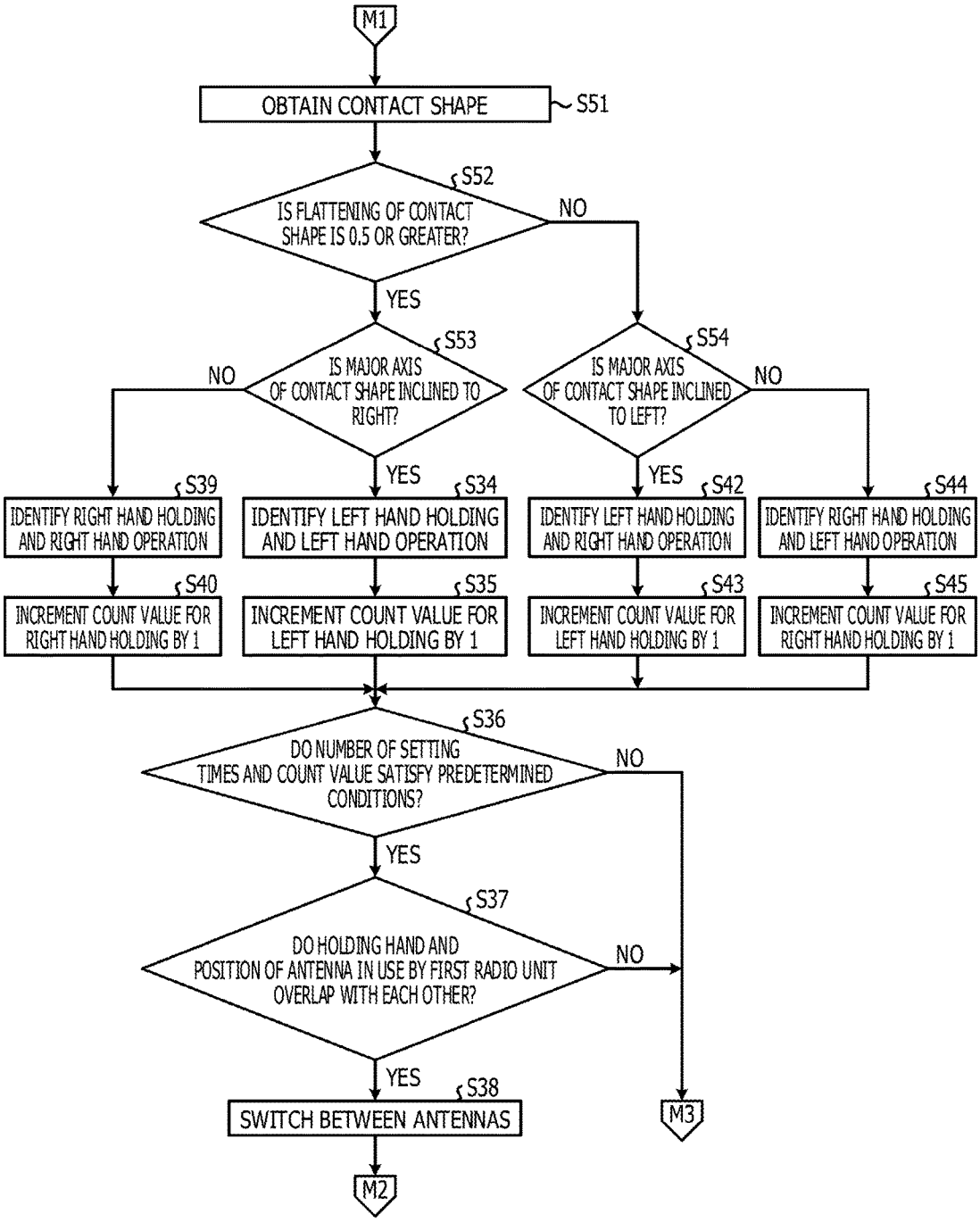
FIG. 7 is a flow chart illustrating an example processing operation of a control unit of the mobile terminal, the control unit being responsible for switching control processing according to the second embodiment.

Next, the operation of the mobile terminal 1 according to the second embodiment will be described. FIG. 7 is a flow chart illustrating an example processing operation of the control unit 21 of the mobile terminal 1, the control unit 21 being responsible for switching control processing according to the second embodiment. The switching control processing illustrated in FIG. 7 is processing in which the holding hand for the mobile terminal 1 is identified based on the inclination of the major axis X of the contact shape α1 detected by the touch sensor 14, and when the holding hand and the position of the antenna in use overlap with each other, the antenna in use is switched to the other antenna.

In M1 illustrated in FIG. 7, the identification unit 21C in the control unit 21 obtains contact shape α1 via the touch sensor 14 (step S51), and determines whether or not the flattening of the contact shape α1 is 0.5 or greater (step S52). When the flattening of the contact shape α1 is 0.5 or greater (YES in step S52), the identification unit 21C identifies the contact shape α1 as a thumb and determines whether or not the major axis X of the contact shape α1 is inclined to the right (step S53).

When the major axis X of the contact shape α1 is inclined to the right (YES in step S53), the identification unit 21C identifies the contact shape α1 as the thumb of the left hand as illustrated in FIG. 6A, and causes the flow to proceed to step S34 to identify left hand holding and left hand operation.

When the major axis X of the contact shape α1 is not inclined to the right (NO in step S53), the identification unit 21C identifies the contact shape α1 as the thumb of the right hand and causes the flow to proceed to step S39 to identify right hand holding and right hand operation.

When the flattening of the contact shape α1 is less than 0.5 (NO in step S52), the identification unit 21C identifies the contact shape α1 as a finger other than a thumb and determines whether or not the major axis X of the contact shape α1 is inclined to the left (step S54). When the major axis of the contact shape α1 is inclined to the left (YES in step S54), the identification unit 21C causes the flow to proceed to step S42 to identify left hand holding and right hand operation. Also, when the major axis X of the contact shape α1 is not inclined to the left (NO in step S54), the identification unit 21C causes the flow to proceed to step S44 to identify right hand holding and left hand operation.

When the flattening of the contact shape α1 is 0.5 or greater and the major axis X of the contact shape α1 is inclined to the right, the control unit 21, which performs the switching control processing illustrated in FIG. 7, identifies left hand holding and left hand operation, then increments the count value for left hand holding by 1.

When the flattening of the contact shape α1 is 0.5 or greater and the major axis X of the contact shape α1 is not inclined to the right, the control unit 21 identifies right hand holding and right hand operation, then increments the count value for right hand holding by 1.

When the flattening of the contact shape α1 is less than 0.5 and the major axis X of the contact shape α1 is inclined to the left, the control unit 21 identifies left hand holding and right hand operation, then increments the count value for left hand holding by 1.

When the flattening of the contact shape α1 is less than 0.5 and the major axis X of the contact shape α1 is not inclined to the left, the control unit 21 identifies right hand holding and left hand operation, then increments the count value for right hand holding by 1.

When the number of setting times of antenna position and the count value for a holding hand satisfy predetermined conditions and the holding hand and the position of the antenna in use by the first radio unit 16 overlap with each other, the control unit 21 switches the antenna in use to the other antenna. Consequently, an antenna having favorable communication quality may be selected while avoiding frequent flip-flop of antenna switching.

The control unit 21 according to the second embodiment identifies the holding hand and the operating hand based on the contact shape α1 obtained by the touch sensor 14, and based on the identification result, identifies one of left hand holding and left hand operation, right hand holding and right hand operation, left hand holding and right hand operation, and right hand holding and left hand operation.

In addition, when the number of setting times of antenna position and the count value for a holding hand satisfy the predetermined conditions and the holding hand and the position of the antenna in use by the first radio unit 16 overlap with each other, the control unit 21 switches the antenna in use to the other antenna. Consequently, an antenna having favorable communication quality may be selected while avoiding frequent flip-flop of antenna switching. Deterioration of communication quality due to a holding hand may be avoided.

In the above-described first embodiment, the holding hand and the operating hand are identified based on the inclination of the electrostatic strength distribution α. However, the holding hand and the operating hand may be identified based on the inclination of an operation locus α2 on the touch sensor 14. The embodiment in this case will be described as a third embodiment below. It is to be noted that the same components as in the mobile terminal 1 according to the first embodiment will be denoted by the same symbol, and description of common components and operations will be omitted.

Third Embodiment

Figure 8A:
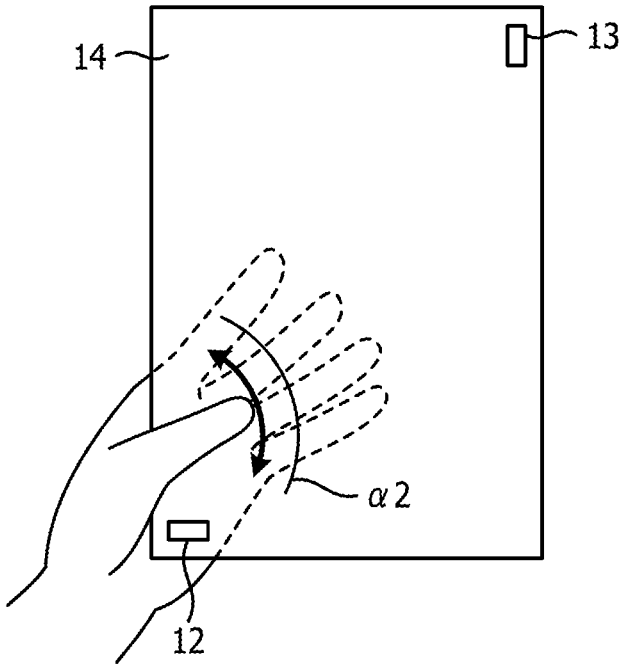
FIG. 8A is an explanatory diagram illustrating an example locus of a holding hand and an operating hand according to a third embodiment.
Figure 8B:
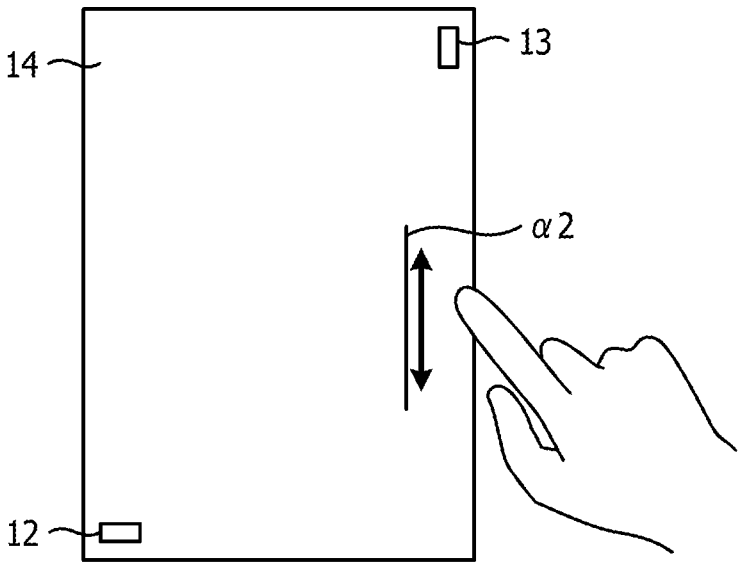
FIG. 8B is an explanatory diagram illustrating an example locus of a holding hand and an operating hand according to the third embodiment.

FIGS. 8A and 8B are each an explanatory diagram illustrating an example locus of a holding hand and an operating hand according to a third embodiment. FIG. 8A is an explanatory diagram illustrating an example operation locus α2 in the case of left hand holding and left hand operation, and FIG. 8B is an explanatory diagram illustrating the example operation locus α2 in the case of left hand holding and right hand operation. An identification unit 21D in the control unit 21 obtains an operation locus α2 on the sensor area from the touch sensor 14, and identifies the holding hand and the operating hand of a user based on the operation locus α2. The identification unit 21D determines whether or not the operation locus α2 has a predetermined curve. When the operation locus α2 has a predetermined curve, the identification unit 21D identifies the operation locus α2 as an operation by the holding hand. In addition, when the operation locus α2 has the predetermined curve, the identification unit 21D determines whether or not the major axis of the operation locus α2 is inclined to the right. It is to be noted that the operation locus α2 is a locus of a predetermined curve which is formed around the base of a finger of the holding hand as a fulcrum point when an operation is performed with the finger of the holding hand as illustrated in FIG. 8A. Alternatively, the operation locus α2 is a linear locus of a finger of the holding hand when an operation is performed with the finger as illustrated in FIG. 8B.

When the operation locus α2 has the predetermined curve and the major axis of the operation locus α2 is inclined to the lower right as illustrated in FIG. 8A, the identification unit 21D identifies left hand holding and left hand operation. In addition, after identifying left hand holding, the identification unit 21D increments the count value for left hand holding by 1.

When the operation locus α2 has the predetermined curve and the major axis of the operation locus α2 is not inclined to the lower right, the identification unit 21D identifies right hand holding and right hand operation. In addition, after identifying right hand holding, the identification unit 21D increments the count value for right hand holding by 1.

When the operation locus α2 has no predetermined curve and the major axis of the operation locus α2 is inclined to the left as illustrated in FIG. 8B, the identification unit 21D identifies left hand holding and right hand operation. In addition, after identifying left hand holding, the identification unit 21D increments the count value for left hand holding by 1.

When the operation locus α2 has no predetermined curve and the major axis of the operation locus α2 is not inclined to the lower left, the identification unit 21D identifies right hand holding and left hand operation. In addition, after identifying right hand holding, the identification unit 21D increments the count value for right hand holding by 1.

Figure 9:
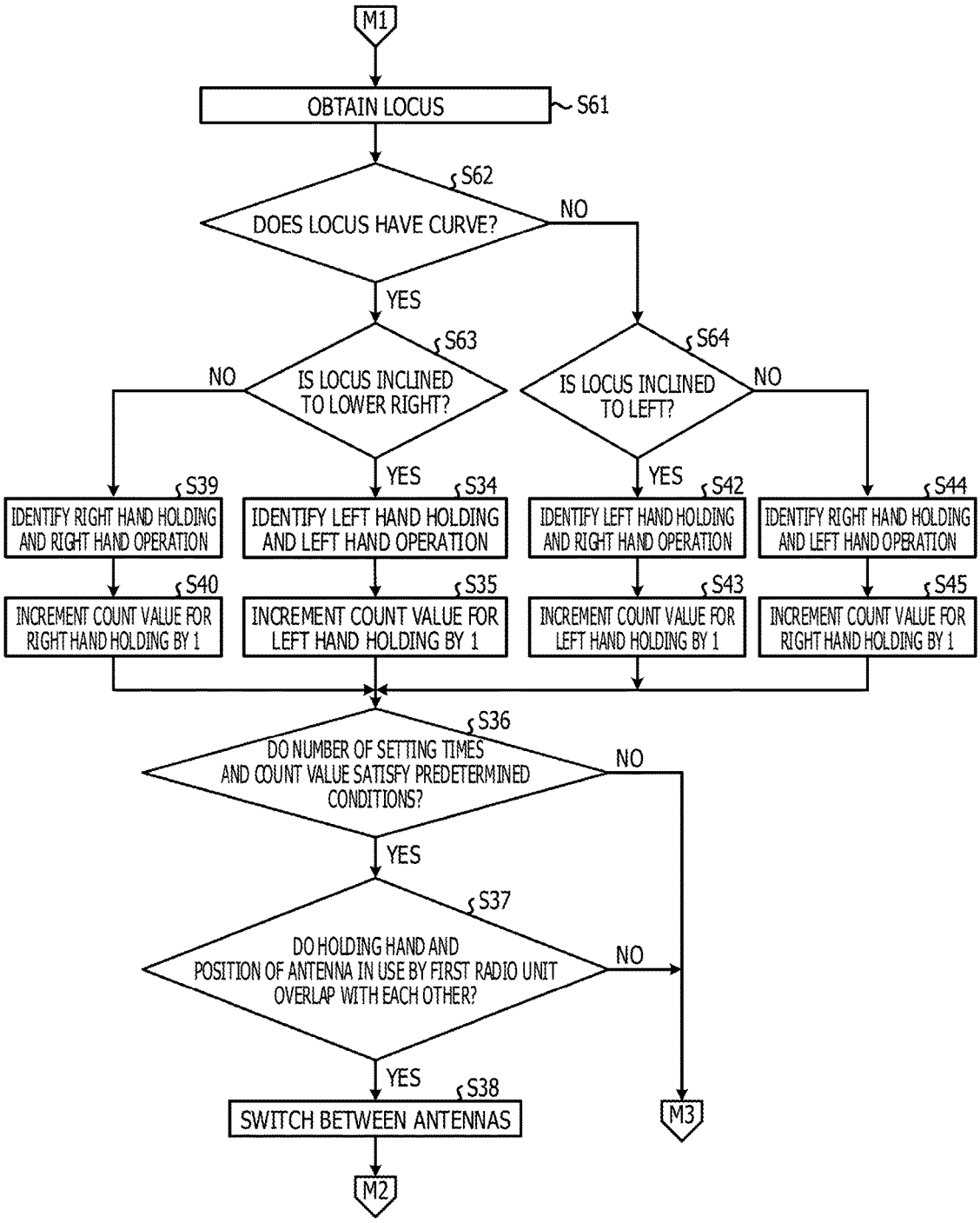
FIG. 9 is a flow chart illustrating an example processing operation of a control unit of the mobile terminal, the control unit being responsible for switching control processing according to the third embodiment.

Next, the operation of the mobile terminal 1 according to the third embodiment will be described. FIG. 9 is a flow chart illustrating an example processing operation of the control unit 21 of the mobile terminal 1, the control unit 21 being responsible for switching control processing according to the third embodiment. The switching control processing illustrated in FIG. 9 is processing in which the holding hand for the mobile terminal 1 is identified based on the inclination of the operation locus α2 detected by the touch sensor 14, and when the holding hand and the position of the antenna in use overlap with each other, the antenna in use is switched to the other antenna.

In M1 illustrated in FIG. 9, the control unit 21 obtains an operation locus α2 via the touch sensor 14 (step S61). After obtaining the operation locus α2, the identification unit 21D determines whether or not the operation locus α2 has the predetermined curve (step S62). When the operation locus α2 has the predetermined curve (YES in step S62), the identification unit 21D identifies the operation locus α2 as an operation of a finger of the holding hand, and determines whether or not the major axis of the operation locus α2 is inclined to the lower right (step S63).

When the major axis of the operation locus α2 is inclined to the lower right (YES in step S63), the identification unit 21D causes the flow to proceed to step S34 to identify left hand holding and left hand operation. On the other hand, when the major axis of the operation locus α2 is not inclined to the lower right (NO in step S63), the identification unit 21D causes the flow to proceed to step S39 to identify right hand holding and right hand operation.

When the operation locus α2 has no predetermined curve (NO in step S62), the identification unit 21D identifies the operation locus α2 as an operation performed by the opposite hand to the holding hand, and determines whether or not the major axis of the operation locus α2 is inclined to the left (step S64). When the major axis of the operation locus α2 is inclined to the left (YES in step S64), the identification unit 21D causes the flow to proceed to step S42 to identify left hand holding and right hand operation. When the major axis of the operation locus α2 is not inclined to the left (NO in step S64), the identification unit 21D causes the flow to proceed to step S44 to identify right hand holding and left hand operation.

When the operation locus α2 has the predetermined curve and the major axis of the operation locus α2 is inclined to the lower right, the control unit 21, which performs the switching control processing illustrated in FIG. 9, identifies left hand holding and left hand operation, then increments the count value for left hand holding by 1.

When the operation locus α2 has the predetermined curve and the major axis of the operation locus α2 is not inclined to the lower right, the control unit 21 identifies right hand holding and right hand operation, then increments the count value for right hand holding by 1.

When the operation locus α2 has no predetermined curve and the major axis of the operation locus α2 is inclined to the left, the control unit 21 identifies left hand holding and right hand operation, then increments the count value for left hand holding by 1.

When the operation locus α2 has no predetermined curve and the major axis of the operation locus α2 is not inclined to the left, the control unit 21 identifies right hand holding and left hand operation, then increments the count value for right hand holding by 1.

When the number of setting times of antenna position and the count value for a holding hand satisfy the predetermined conditions and the holding hand and the position of the antenna in use by the first radio unit 16 overlap with each other, the control unit 21 switches the antenna in use to the other antenna. Consequently, an antenna having favorable communication quality may be selected while avoiding frequent flip-flop of antenna switching.

The control unit 21 according to the third embodiment identifies the holding hand and the operating hand based on the operation locus α2 obtained by the touch sensor 14, and based on the identification result, identifies one of left hand holding and left hand operation, right hand holding and right hand operation, left hand holding and right hand operation, and right hand holding and left hand operation.

Furthermore, when the number of setting times of antenna position and the count value for a holding hand satisfy the predetermined conditions and the holding hand and the position of the antenna in use by the first radio unit 16 overlap with each other, the control unit 21 switches the antenna in use to the other antenna. Consequently, an antenna having favorable communication quality may be selected while avoiding frequent flip-flop of antenna switching. That is, deterioration of communication quality due to a holding hand may be avoided.

In the above-described second embodiment, the holding hand and the operating hand are identified based on the inclination of the major axis X of the contact shape α1. However, a threshold value may be set for determining whether or not the contact shape α1 is an ellipse, and the threshold value may be further adjustable. The embodiment in this case will be described as a fourth embodiment below. It is to be noted that the same components as in the mobile terminal 1 according to the second embodiment will be denoted by the same symbol, and description of common components and operations will be omitted.

Fourth Embodiment

Figure 10:
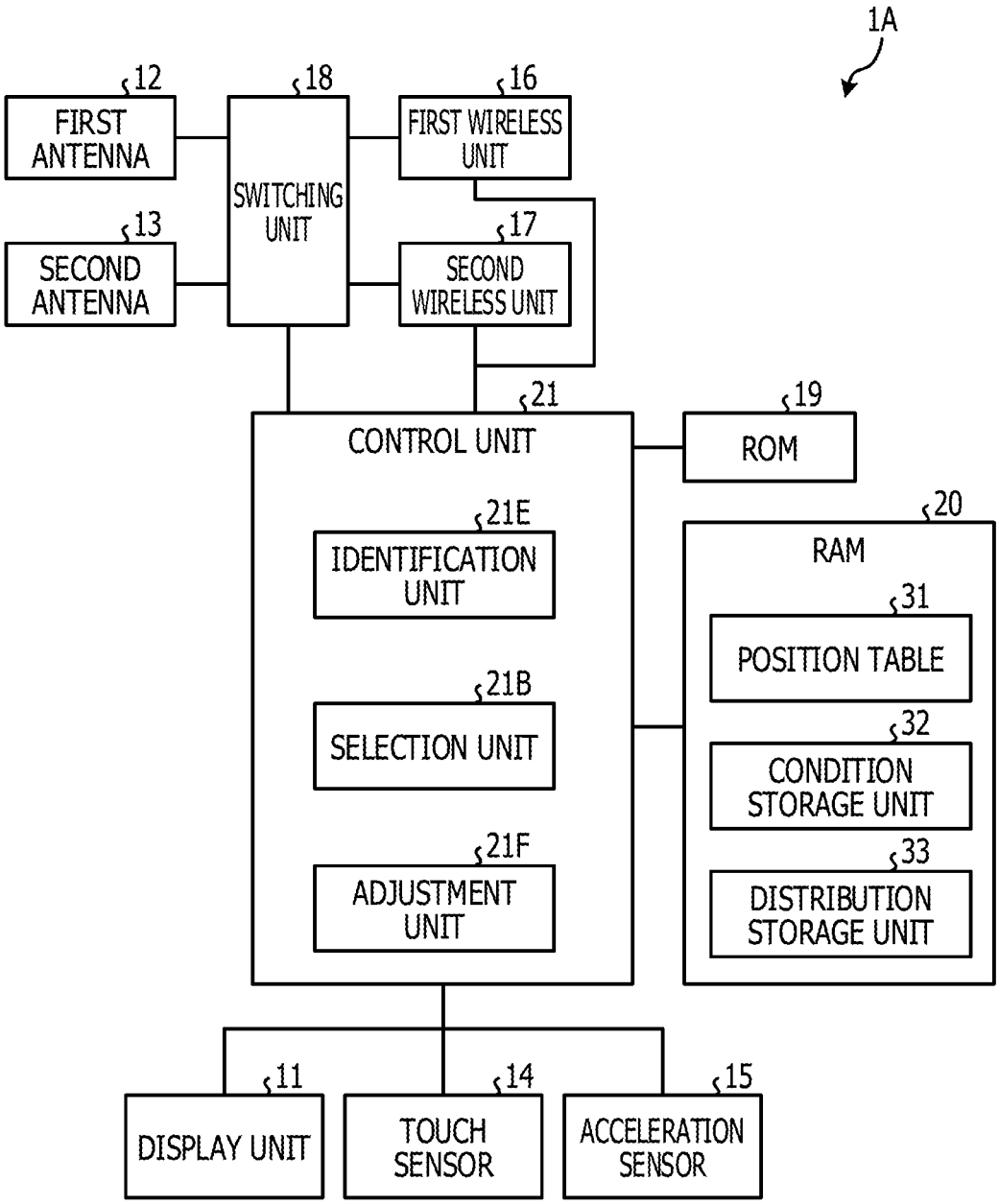
FIG. 10 is a block diagram illustrating an example mobile terminal according to a fourth embodiment.

FIG. 10 is a block diagram illustrating an example mobile terminal 1A according to a fourth embodiment. The control unit 21 of the mobile terminal 1A illustrated in FIG. 10 has an identification unit 21E, a selection unit 21B, and an adjustment unit 21F as process functions. The identification unit 21E determines whether or not the contact area of the contact shape α1 is a threshold value or greater, and when the contact area is the threshold value or greater, the identification unit 21E identifies an operation of a thumb. When the contact area of the contact shape α1 is the threshold value or greater and the major axis of the contact shape α1 is inclined to the right, the identification unit 21E identifies left hand holding and left hand operation. In addition, after identifying left hand holding, the identification unit 21E increments the count value for left hand holding by 1.

When the contact area of the contact shape α1 is the threshold value or greater and the major axis of the contact shape α1 is not inclined to the right, the identification unit 21E identifies right hand holding and right hand operation. In addition, after identifying right hand holding, the identification unit 21E increments the count value for right hand holding by 1.

When the contact area of the contact shape α1 is less than the threshold value and the major axis of the contact shape α1 is inclined to the left, the identification unit 21E identifies left hand holding and right hand operation. In addition, after identifying left hand holding, the identification unit 21E increments the count value for left hand holding by 1.

When the contact area of the contact shape α1 is less than the threshold value and the major axis of the contact shape α1 is not inclined to the left, the identification unit 21E identifies right hand holding and left hand operation. In addition, after identifying right hand holding, the identification unit 21E increments the count value for right hand holding by 1.

When the number of setting times and the count value further satisfy predetermined conditions and the holding hand and the position of the antenna in use by the first radio unit 16 overlap with each other, the adjustment unit 21F in the control unit 21 switches the antenna in use to the other antenna.

After switching to the other antenna, the adjustment unit 21F measures a received signal strength indicator (RSSI) value of the antenna after switching. The adjustment unit 21F compares the RSSI value of the antenna after switching with the RSSI value of the antenna before switching, and determines whether or not the RSSI value has decreased after switching. When the RSSI value after antenna switching has decreased, the adjustment unit 21F calculates an adjusted threshold value (β+5%) by adding a predetermined adjustment value (5%) to a threshold value β that is currently set. The predetermined adjustment value is the value of 5% of a threshold value β set before antenna switching in the later-described step S91 illustrated in FIG. 12.

When the contact area of the contact shape α1 is the adjusted threshold value (β+5%) or greater, the identification unit 21E identifies the holding hand and the operating hand. The selection unit 21B determines whether or not the holding hand and the position of the antenna in use by the first radio unit 16 overlap with each other. When the holding hand and the position of the antenna in use overlap with each other, the adjustment unit 21F measures RSSI value after antenna switching after setting of the adjusted threshold value (α+5%). When the holding hand and the position of the antenna in use by the first radio unit 16 do not overlap with each other, the adjustment unit 21F measures RSSI value after setting of the adjusted threshold value (β+5%) which is obtained by adding the predetermined adjustment value to the threshold value β currently set.

In addition, the adjustment unit 21F calculates an adjusted threshold value (β−5%) by subtracting the predetermined adjustment value from the threshold value β currently set. When the contact area of the contact shape α1 is the adjusted threshold value (β−5%) or greater, the identification unit 21E identifies the holding hand and the operating hand. The selection unit 21B determines whether or not the holding hand and the position of the antenna in use by the first radio unit 16 overlap with each other. When the holding hand and the position of the antenna in use by the first radio unit 16 overlap with each other, the adjustment unit 21F measures RSSI value after antenna switching after setting of the adjusted threshold value (β−5%). When the holding hand and the position of the antenna in use by the first radio unit 16 do not overlap with each other, the adjustment unit 21F measures RSSI value after setting of the adjusted threshold value (β−5%) which is obtained by subtracting the predetermined adjustment value from the threshold value β currently set.

After obtaining the RSSI value after setting of the adjusted threshold value (α+5%) and the RSSI value after setting of the adjusted threshold value (α−5%), the adjustment unit 21F determines whether or not only one of the RSSI values has changed. When only one RSSI value has changed, the adjustment unit 21F changes the adjusted threshold value for the RSSI value which has not decreased to the threshold value set in the later-described step S72 illustrated in FIG. 11.

Figure 11:
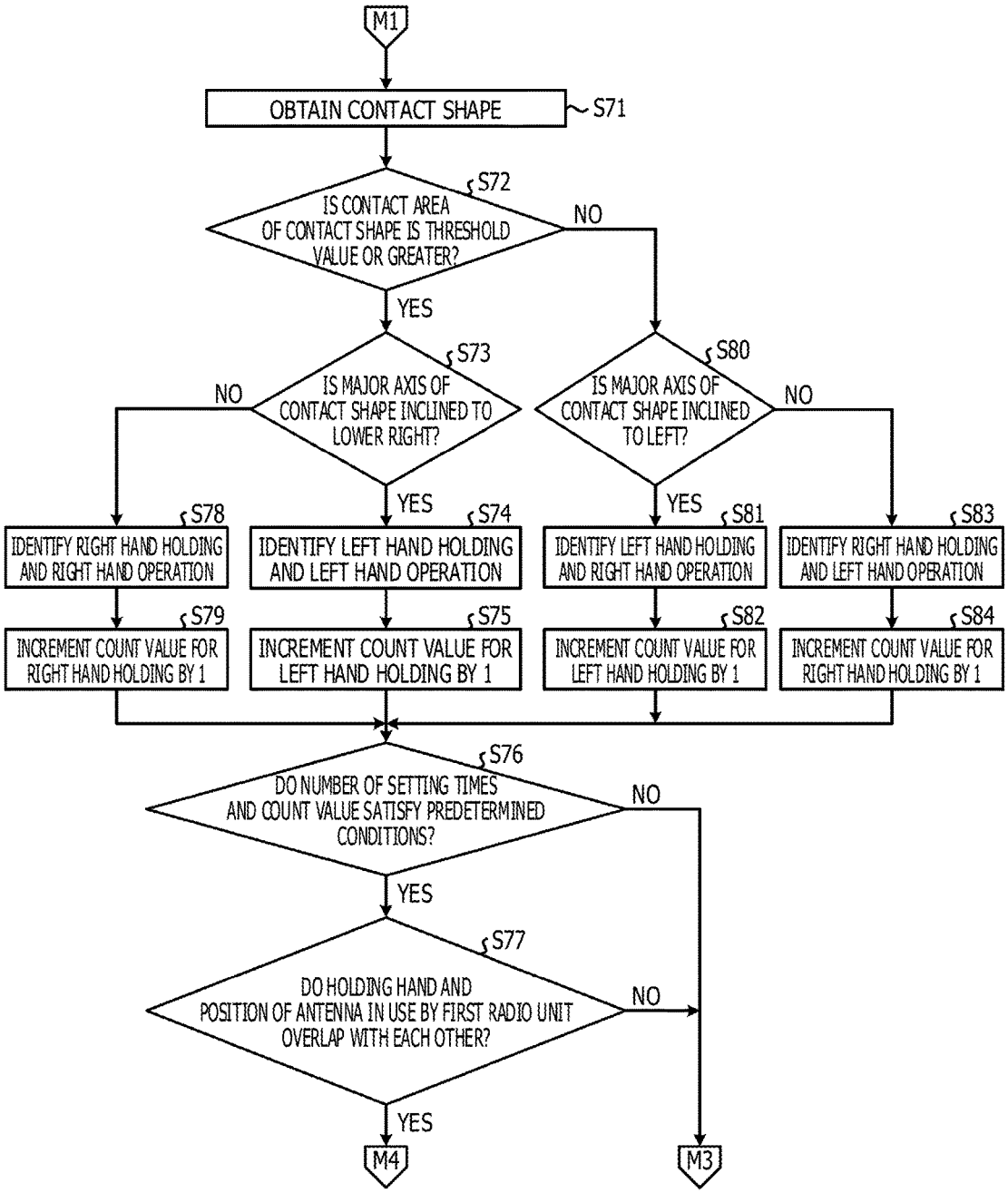
FIG. 11 is a flow chart illustrating an example processing operation of a control unit of the mobile terminal, the control unit being responsible for switching control processing according to the fourth embodiment.

FIG. 11 is a flow chart illustrating an example processing operation of the control unit 21 of the mobile terminal 1, the control unit 21 being responsible for switching control processing according to the fourth embodiment. The switching control processing illustrated in FIG. 11 is processing in which the positions of the holding hand and the operating hand are identified based on the area of the contact shape α1 and the inclination of the contact shape α1, and when the holding hand and the position of the antenna in use by the first radio unit 16 overlap with each other, the antenna in use is switched to the other antenna.

In M1 illustrated in FIG. 11, the identification unit 21E of the control unit 21 obtains contact shape α1 via the touch sensor 14 (step S71). The identification unit 21E determines whether or not the contact area of the contact shape α1 is a threshold value or greater (step S72). When the contact area of the contact shape α1 is the threshold value or greater (YES in step S72), the identification unit 21E identifies the contact shape α1 as a thumb, and determines whether or not the major axis X of the contact shape α1 is inclined to the right (step S73).

When the major axis X of the contact shape α1 is inclined to the lower right (YES in step S73), the identification unit 21E identifies the contact shape α1 as the thumb of the left hand, and identifies left hand holding and left hand operation (step S74). Since left hand holding is identified, the identification unit 21E increments the count value for left hand holding by 1 (step S75).

The selection unit 21B determines whether or not the number of setting times and the count value satisfy predetermined conditions (step S76). When the number of setting times and the count value satisfy the predetermined conditions (YES in step S76), the selection unit 21B determines whether or not the holding hand and the position of the antenna in use by the first radio unit 16 overlap with each other (step S77). When the holding hand and the position of the antenna in use by the first radio unit 16 overlap with each other (YES in step S77), the selection unit 21B causes the flow to proceed to M4 illustrated in FIG. 12.

When the major axis X of the contact shape α1 is not inclined to the lower right (NO in step S73), the identification unit 21E identifies the contact shape α1 as the thumb of the right hand, and identifies right hand holding and right hand operation (step S78). Since right hand holding is identified, the identification unit 21E increments the count value for right hand holding by 1 (step S79), and causes the flow to proceed to step S76 to determine whether or not the number of setting times and the count value satisfy the predetermined conditions.

When the contact area of the contact shape α1 is less than a threshold value (NO in step S72), the identification unit 21E determines whether or not the major axis X of the contact shape α1 is inclined to the left (step S80). When the major axis X of the contact shape α1 is inclined to the left (YES in step S80), the identification unit 21E identifies left hand holding and right hand operation (step S81). Since left hand holding is identified, the identification unit 21E increments the count value for left hand holding by 1 (step S82), and causes the flow to proceed to step S76 to determine whether or not the number of setting times and the count value satisfy the predetermined conditions.

When the major axis X of the contact shape α1 is not inclined to the left (NO in step S80), the identification unit 21E identifies right hand holding and left hand operation (step S83). Since right hand holding is identified, the identification unit 21E increments the count value for right hand holding by 1 (step S84), and causes the flow to proceed to step S76 to determine whether or not the number of setting times and the count value satisfy the predetermined conditions.

When the number of setting times and the count value do not satisfy the predetermined conditions (NO in step S76), the selection unit 21B causes the flow to proceed to M3 illustrated in FIG. 4. When the holding hand and the position of the antenna in use by the first radio unit 16 do not overlap with each other (NO in step S77), the selection unit 21B causes the flow to proceed to M3 illustrated in FIG. 4.

Figure 12:
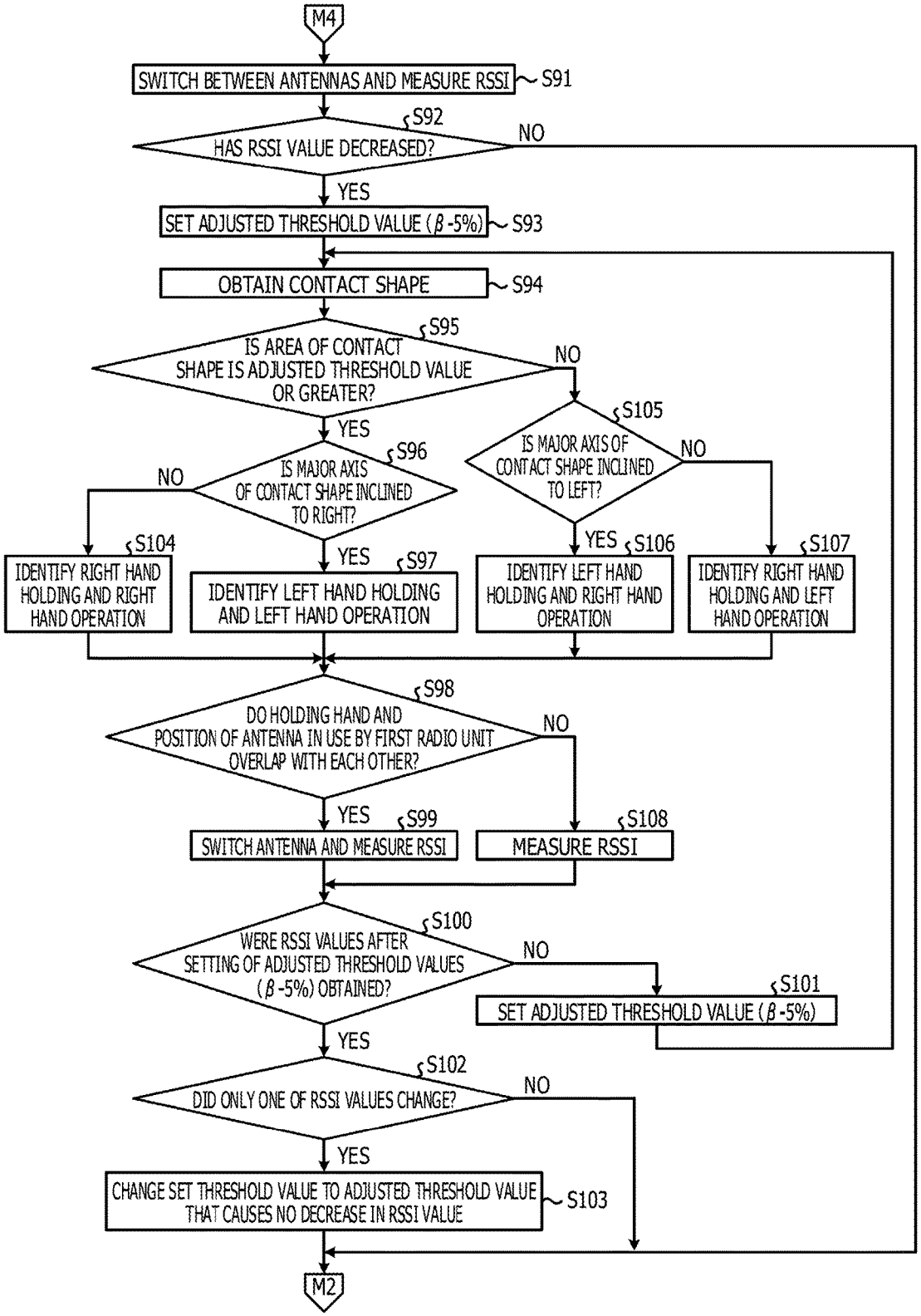
FIG. 12 is a flow chart illustrating an example processing operation of a control unit of the mobile terminal, the control unit being responsible for the switching control processing according to the fourth embodiment.

In M4 illustrated in FIG. 12, the adjustment unit 21F in the control unit 21 measures RSSI value after antenna switching (step S91). The adjustment unit 21F determines whether or not the RSSI value after antenna switching has decreased (step S92). The adjustment unit 21F compares the RSSI value of the antenna after switching with the RSSI value of the antenna before switching, and determines whether or not the RSSI value has decreased after switching.

When the RSSI value has decreased after switching (YES in step S92), the adjustment unit 21F calculates an adjusted threshold value (β+5%) by adding the predetermined adjustment value (5%) to the current threshold value β (step S93). The identification unit 21E obtains contact shape α1 (step S94), and determines whether or not the contact area of the obtained contact shape α1 is the adjusted threshold value or greater (step S95).

When the contact area of the contact shape α1 is the adjusted threshold value or greater (YES in step S95), the identification unit 21E determines whether or not the major axis X of the contact shape α1 is inclined to the right (step S96). When the major axis X of the contact shape α1 is inclined to the right (YES in step S96), the identification unit 21E identifies left hand holding and left hand operation (step S97), and determines whether or not the holding hand and the position of the antenna in use by the first radio unit 16 overlap with each other (step S98).

When the holding hand and the position of the antenna in use by the first radio unit 16 overlap with each other (YES in step S98), the selection unit 21B switches the antenna in use by the first radio unit 16 to the other antenna, and measures RSSI value with the antenna after switching (step S99).

The adjustment unit 21F determines whether or not both RSSI values have been obtained, one of the RSSI values being for when an adjusted threshold value (β+5%) is set, the other one of the RSSI values being for when an adjusted threshold value (β−5%) is set (step S100). When both RSSI values have not been obtained (NO in step S100), the adjustment unit 21F sets the adjusted threshold value (β−5%) by subtracting the predetermined adjustment value from the threshold value β (step S101). The adjustment unit 21F sets the threshold value to the adjusted threshold value (β−5%) and causes the flow to proceed to step S94 to determine whether or not the contact area of the contact shape α1 is the adjusted threshold value (β−5%) or greater.

The adjustment unit 21F compares the RSSI value for an adjusted threshold value of (β+5%) with the RSSI value for an adjusted threshold value of (β−5%), and it is determined whether or not only one of the RSSI values has changed (step S102). When only one RSSI value has changed (YES in step S102), the adjustment unit 21F applies an adjusted threshold value to the set threshold value (step S103), and causes the flow to proceed to M2 in FIG. 4, the adjusted threshold value for which RSSI value has not decreased. Consequently, the adjustment unit 21F may adjust the set threshold value used for comparison in step S72 illustrated in FIG. 11. When only one RSSI value has not changed (NO in step S102), the adjustment unit 21F causes the flow to proceed to M2 in FIG. 4.

When the major axis X of the contact shape α1 is not inclined to the right (NO in step S96), the identification unit 21E identifies right hand holding and right hand operation (step S104). In addition, the selection unit 21B causes the flow to proceed to step S98 to determine whether or not the holding hand and the position of the antenna in use by the first radio unit 16 overlap with each other.

When the contact area of the contact shape α1 is less than the adjusted threshold value (NO in step S95), the identification unit 21E determines whether or not the major axis X of the contact shape α1 is inclined to the left (step S105). When the major axis X of the contact shape α1 is inclined to the left (YES in step S105), the identification unit 21E identifies left hand holding and right hand operation (step S106), and causes the flow to proceed to step S98 to determine whether or not the holding hand and the position of the antenna in use by the first radio unit 16 overlap with each other.

When the major axis X of the contact shape α1 is not inclined to the left (NO in step S105), the identification unit 21E identifies right hand holding and left hand operation (step S107). In addition, the selection unit 21B causes the flow to proceed to step S98 to determine whether or not the holding hand and the position of the antenna in use by the first radio unit 16 overlap with each other.

When the holding hand and the position of the antenna in use by the first radio unit 16 do not overlap with each other (NO in step S98), the selection unit 21B measures RSSI value (step S108). The selection unit 21B causes the flow to proceed to step S100 to determine whether or not both RSSI values for the adjusted threshold value ±5% have been obtained.

When the contact area of the contact shape α1 is the threshold value or greater and the major axis X of the contact shape α1 is inclined to the right, the control unit 21, which has performed the switching control processing illustrated in FIG. 11, identifies left hand holding and left hand operation, then increments the count value for left hand holding by 1.

When the contact area of the contact shape α1 is the threshold value or greater and the major axis X of the contact shape α1 is not inclined to the right, the control unit 21 identifies right hand holding and right hand operation, then increments the count value for right hand holding by 1.

When the contact area of the contact shape α1 is less than the threshold value and the major axis X of the contact shape α1 is inclined to the left, the control unit 21 identifies left hand holding and right hand operation, then increments the count value for left hand holding by 1.

When the contact area of the contact shape α1 is less than the threshold value and the major axis X of the contact shape α1 is not inclined to the left, the control unit 21 identifies right hand holding and left hand operation, then increments the count value for right hand holding by 1.

When the number of setting times of antenna position and the count value for a holding hand satisfy the predetermined conditions and the holding hand and the position of the antenna in use by the first radio unit 16 overlap with each other, the control unit 21 switches the antenna in use to the other antenna. Consequently, an antenna having favorable communication quality may be selected while avoiding frequent flip-flop of antenna switching.

In addition, the control unit 21 obtains RSSI value after switching the antenna in use, and when the RSSI value after the antenna switching has decreased, sets an adjusted threshold value (β+5%) and measures RSSI value using the adjusted threshold value that has been set. In addition, the control unit 21 sets an adjusted threshold value (β−5%) and measures RSSI value using the adjusted threshold value that has been set. The control unit 21 changes the set threshold value to an adjusted threshold value which is one of the RSSI value for an adjusted threshold value of (β+5%) and the RSSI value for an adjusted threshold value of (β−5%) and for which RSSI value has not decreased. Consequently, the control unit 21 may adjust the threshold value for identifying a thumb of a user.

The control unit 21 of the fourth embodiment described above identifies the holding hand and the operating hand based on the contact area of the contact shape α1 and the inclination of the major axis X of the contact shape α1, and based on the identification result, identifies one of left hand holding and left hand operation, right hand holding and right hand operation, left hand holding and right hand operation, and right hand holding and left hand operation.

Furthermore, when the number of setting times of antenna position and the count value for a holding hand satisfy the predetermined conditions and the holding hand and the position of the antenna in use by the first radio unit 16 overlap with each other, the control unit 21 switches the antenna in use to the other antenna. Consequently, an antenna having favorable communication quality may be selected. That is, deterioration of communication quality due to a holding hand may be avoided.

In addition, when the RSSI value decreases after the antenna switching, the control unit 21 measures the RSSI value for an adjusted threshold value of (β+5%) and the RSSI value for an adjusted threshold value of (β−5%). The control unit 21 changes the threshold value to an adjusted threshold value which is one of the RSSI value for an adjusted threshold value of (β+5%) and the RSSI value for an adjusted threshold value of (β−5%) and for which RSSI value has not decreased, provided that only one of the RSSI values has changed. Consequently, the threshold value for identifying a thumb of a user may be adjusted.

In the fourth embodiment described above, from step S91 of M4 illustrated in FIG. 12, the flow proceeds to step S92 to determine whether or not the RSSI value has decreased after antenna switching. Alternatively, after the antenna switching in step S91, the flow may proceed to M2 illustrated in FIG. 4.

In the embodiment described above, the number of setting times and the count value for a holding hand are counted for every 100 msec. However, the counting period is not limited to 100 msec.

In the fourth embodiment described above, when the contact area of the contact shape α1 is a threshold value or greater, the contact shape α1 is identified as a thumb. Alternatively, the contact area of each finger of a user of the mobile terminal 1A may be pre-stored, and the threshold value may be set to the actual contact area.

In the embodiment described above, the entire surface of the mobile terminal 1 (1A) serves as the sensor area of the touch sensor 14. Alternatively, only the display screen of the display unit 11 of the mobile terminal 1 may serve as the sensor area of the mobile terminal 1.

A projected capacitive touch sensor is used as the touch sensor 14 according to the embodiment described above. Alternatively, a surface capacitive touch sensor or a resistive film touch sensor may be used.

In the embodiment described above, communication operation for position registration is performed, for example, every hour in screen lock state or standby state in which application is not activated in the mobile terminal 1. However, an impedance may be measured to be detected and an antenna may be switched every two consecutive hours.

In the embodiment described above, when the holding hand and the position of the antenna in use by the first radio unit 16 overlap with each other, switching control is performed on the antenna in use. However, switching control processing may be performed only when a radio system using 2 GHz high frequency band as an example is adopted. That is, for example when a radio system using 800 MHz low frequency band with less deterioration of reception performance is adopted, switching control processing may not be performed. Consequently, frequent flip-flop of useless antenna switching may be avoided.

In the embodiment described above, the position of each antenna is expressed by a quadrisection element of a 2×2 matrix. However, without being limited to quadrisection, highly accurate switching control processing may be achieved by further fine division.

High switching frequency in the first to fourth embodiments described above causes reduction in receiving efficiency, and thus it is demanded that switching from the basic disposition be restrained to a minimum. For example, when the first antenna 12 is covered with a hand during use of the first antenna 12 in a radio system using 2 GHz band, the first antenna 12 to switched to the second antenna 13. In the first to fourth embodiments described above, the mobile terminal 1 having two radio units and two antennas has been illustrated. However, without being limited to this, the mobile terminal 1 may have four radio units and four antennas. The embodiment in this case will be described as a fifth embodiment below.

Fifth Embodiment

Figure 13A:
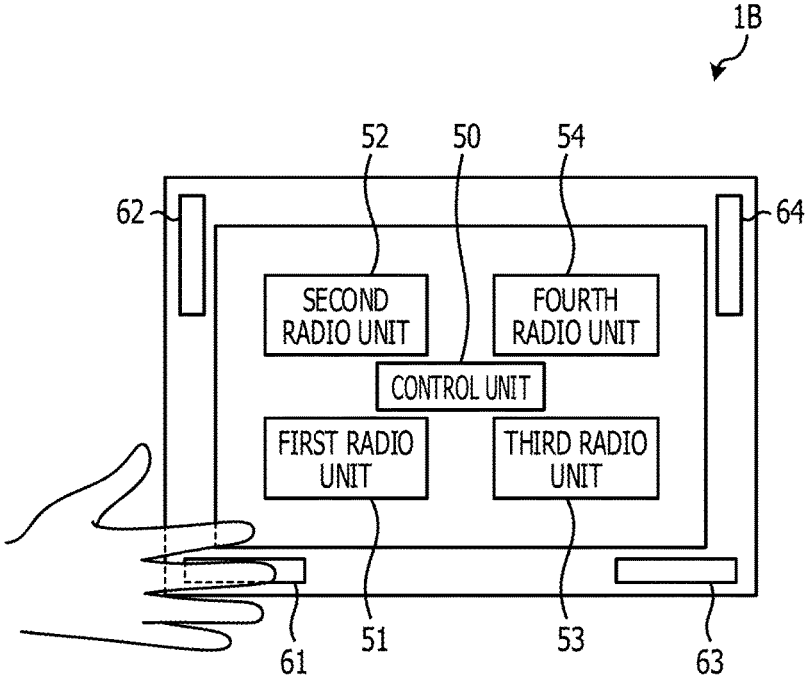
FIG. 13A is an explanatory diagram illustrating an example mobile terminal according to a fifth embodiment.
Figure 13B:
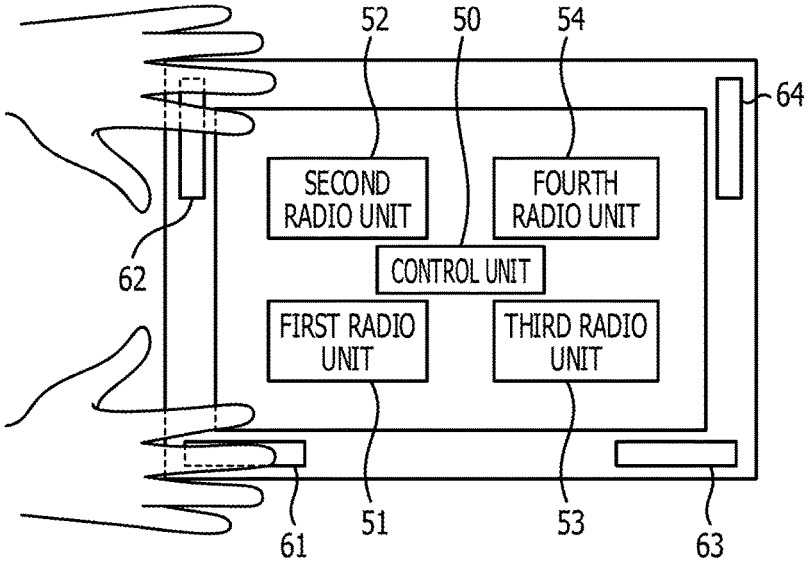
FIG. 13B is an explanatory diagram illustrating an example mobile terminal according to the fifth embodiment.

FIGS. 13A and 13B are each an explanatory diagram illustrating example antenna switching of a mobile terminal 1B according to a fifth embodiment. The mobile terminal 1B illustrated in FIG. 13 has a first radio unit 51, a second radio unit 52, a third radio unit 53, and a fourth radio unit 54. The first radio unit 51 has a transmission function and a reception function in a radio system using a high frequency band, for example. The second radio unit 52 has a reception function in a radio system using a high frequency band. The third radio unit 53 has a transmission function and a reception function in a radio system using a low frequency band, for example. The fourth radio unit 54 has a reception function in a radio system using a low frequency band, for example.

The mobile terminal 1B has a first antenna 61, a second antenna 62, a third antenna 63, and a fourth antenna 64. Normally, it is assumed that the first antenna 61 is connected to the first radio unit 51, the second antenna 62 is connected to the second radio unit 52, the third antenna 63 is connected to the third radio unit 53, and the fourth antenna 64 is connected to the fourth radio unit 54.

For example, the first antenna 61 is covered with a hand in the mobile terminal 1B of FIG. 13A. For the first radio unit 51, the control unit 50 of the mobile terminal 1B switches from the first antenna 61 to the second antenna 62. In addition, for the second radio unit 52, the control unit 50 switches from the second antenna 62 to the first antenna 61.

For example, the first antenna 61 and the second antenna 62 are covered with a hand in the mobile terminal 1B of FIG. 13B. For the first radio unit 51, the control unit 50 switches from the first antenna 61 to the fourth antenna 64. For the fourth radio unit 54, the control unit 50 switches from the fourth antenna 64 to the first antenna 61. It is to be noted that the control unit 50 of the mobile terminal 1B according to the fifth embodiment may manage a condition table for antenna switching, and may switch between antennas based on the table data in the condition table.

This embodiment is useful for multiple-input and multiple-output (MIMO) and carrier aggregation that use a plurality of antennas.

Each component in the illustrated units is not necessarily to be physically formed as illustrated. That is, specific configuration of distribution and integration of each unit is not limited to the illustrated configuration, and all or part of the configuration may be functionally or physically distributed or integrated and formed in any unit according to various loads and use conditions.

In addition, all or any part of various processing functions performed by each device may be executed on a central processing unit (CPU) (or a micro-computer such as a micro processing unit (MPU), a micro controller unit (MCU)). Also, it is naturally understood that all or any part of the various processing functions may be executed on a program that is analyzed and executed by a CPU (or a micro-computer such as an MPU, an MCU) or on hardware using wired logic.

Figure 14:
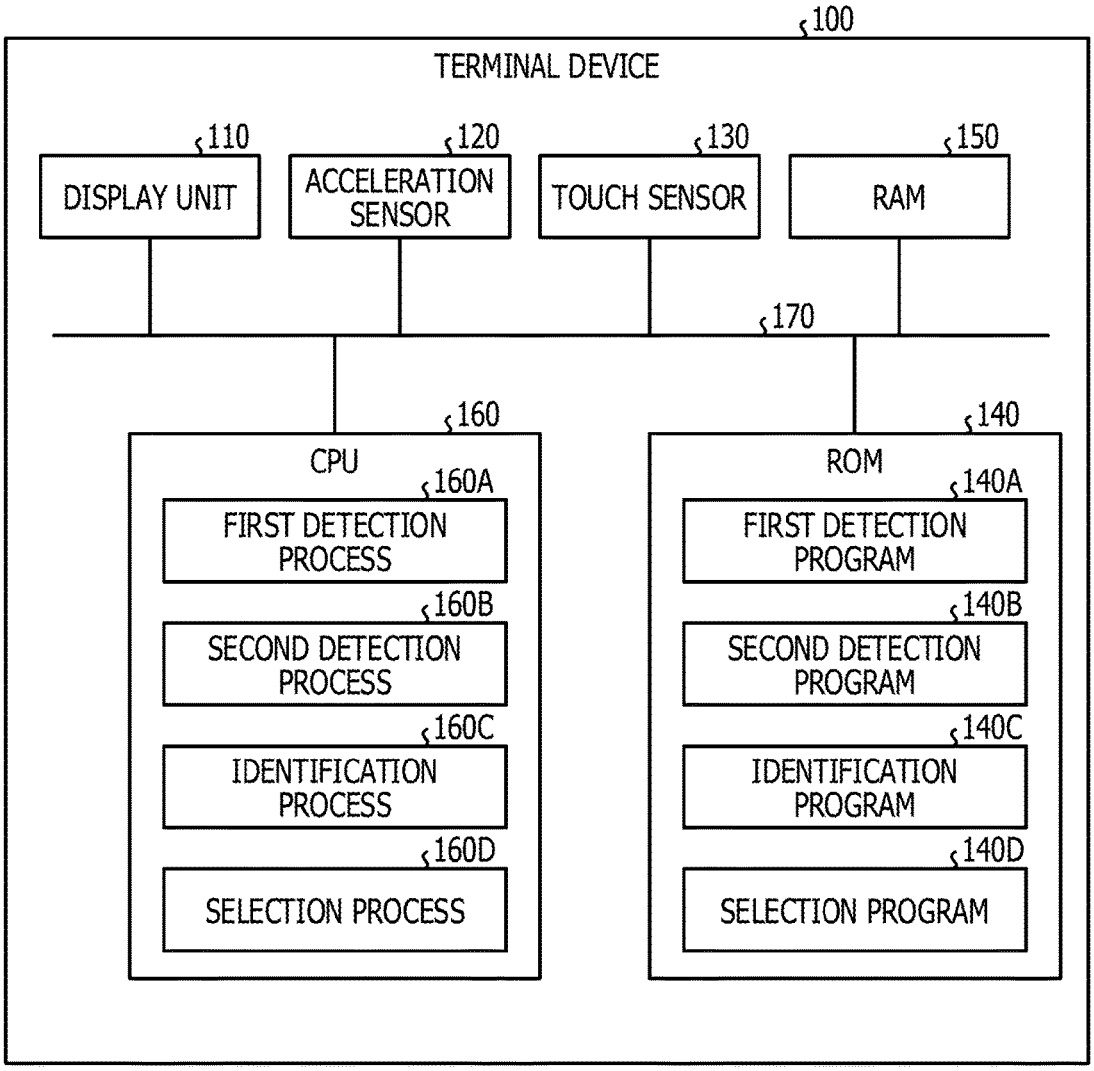
FIG. 14 is an explanatory diagram illustrating an example terminal device that executes an antenna switching program.

The various processing described in this embodiment may be achieved by causing a processor such as a CPU in the terminal device to execute a prepared program. Thus, an example terminal device will be described below that executes a program which has the same function as in the above embodiments. FIG. 14 is an explanatory diagram illustrating an example terminal device that executes an antenna switching program.

A terminal device 100 executes the antenna switching program illustrated in FIG. 14, and includes a display unit 110, an acceleration sensor 120, a touch sensor 130, a ROM 140, a RAM 150 and a CPU 160. In addition, the display unit 110, the acceleration sensor 120, the touch sensor 130, the ROM 140, the RAM 150 and the CPU 160 are connected to one another via a bus 170.

The ROM 140 pre-stores an antenna switching program that has the same function as in the above embodiments. The ROM 140 stores a first detection program 140A, a second detection program 140B, an identification program 140C, and an selection program 140D as antenna switching programs. It is to be noted that the antenna switching programs may be stored in a computer-readable recording medium via a drive (not illustrated) rather than the ROM 140. The recording medium includes, for example, a portable recording medium such as a CD-ROM, a DVD disc, a USB memory, and a semiconductor memory such as a flash memory.

The CPU 160 reads the first detection program 140A from the ROM 140, thereby functioning as a first detection process 160A. In addition, the CPU 160 reads the second detection program 140B from the ROM 140, thereby functioning as a second detection process 160B. The CPU 160 reads the identification program 140C from the ROM 140, thereby functioning as an identification process 160C. In addition, the CPU 160 reads the selection program 140D from the ROM 140, thereby functioning as a selection process 160D.

The RAM 150 stores the position of each antenna of the main body of the terminal device 100 for each of holding manners. The acceleration sensor 120 detects acceleration of the main body of the terminal device 100 in each of the directions of three axes. The touch sensor 130 detects a contact shape on the surface of the terminal device 100.

The CPU 160 detects a holding manner for the main body of the terminal device 100 based on a result of the detection by the acceleration sensor 120. The CPU 160 detects a shape based on a result of the detection by the touch sensor 130, the shape indicating the shadow of an object pointing to the surface of the terminal device 100. The CPU 160 identifies a hand that holds the main body of the terminal device 100, based on the shape. In addition, the CPU 160 switches the antenna which overlaps with the holding hand to the other antenna based on the identified hand and the position of an antenna of the main body of the terminal device 100, the antenna corresponding to the detected holding manner. Consequently, an antenna having favorable communication quality may be selected by switching.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A terminal device comprising:

a first memory that stores a position of each of antennas included in a main body of a terminal device for each of holding manners for the main body of the terminal device;

a second memory;

a processor coupled to the second memory, configured to detect a holding manner for the main body of the terminal device including the antennas, detect a shape indicating a shadow of an object pointing to a surface of the terminal device, identify a holding hand that holds the main body of the terminal device, based on the detected shape, and switch an antenna which overlaps with the holding hand to another antenna based on the identified holding hand and the position of each antenna stored in the first memory, the antenna corresponding to the detected holding manner.

2. The terminal device according to claim 1, wherein the processor identifies the holding hand based on a flattening of the shape.

3. The terminal device according to claim 1, wherein the processor identifies the holding hand based on an area of the shape.

4. The terminal device according to claim 1, wherein the processor identifies the holding hand based on a major axis of the shape.

5. The terminal device according to claims 1, wherein the processor detects the shape by an electrostatic strength.

6. A machine readable medium storing a program that, when executed by a processor, causes the processor to perform operations on a terminal device including antennas, the operations comprising:

detecting a holding manner for a main body of the terminal device;

detecting a shape indicating a shadow of an object pointing to a surface of the terminal device;

identifying a holding hand that holds the main body of the terminal device, based on the shape; and switching an antenna which overlaps with the holding hand to another antenna based on the identified holding hand and the position of each antenna of the main body of the terminal device, the antenna corresponding to the detected holding manner.

7. A method of switching an antenna, the method comprising:

detecting a holding manner for a main body of a terminal device including antennas;

detecting a shape indicating a shadow of an object pointing to a surface of the terminal device;

identifying a holding hand that holds the main body of the terminal device, based on the shape; and switching an antenna which overlaps with the holding hand to another antenna based on the identified holding hand and the position of each antenna of the main body of the terminal device, the antenna corresponding to the detected holding manner.

* * * * *